US006351256B1

(12) United States Patent
Jones et al.

(10) Patent No.: US 6,351,256 B1
(45) Date of Patent: Feb. 26, 2002

(54) ADDRESSING METHOD AND APPARATUS

(75) Inventors: John Clifford Jones, Malvern; Jonathan Rennie Hughes, St. John's, both of (GB)

(73) Assignees: Sharp Kabushiki Kaisha, Osaka (JP); The Secretary of State for Defence in Her Brittanic Majesty's Government of the United Kingdom of Great Britain and Northern Ireland, Farnborough (GB)

( * ) Notice: Subject to any disclaimer, the term of this patent is extended or adjusted under 35 U.S.C. 154(b) by 0 days.

(21) Appl. No.: 09/139,002

(22) Filed: Aug. 24, 1998

(30) Foreign Application Priority Data

Aug. 29, 1997 (GB) ..... 9718369

(51) Int. Cl.[7] ..... G09G 3/36
(52) U.S. Cl. ..... 345/94; 345/208
(58) Field of Search ..... 345/87, 94, 95, 345/97, 99, 100, 101, 208, 210; 359/56

(56) References Cited

U.S. PATENT DOCUMENTS 4,870,398 A 9/1989 Bos ..... 340/784
5,459,481 A 10/1995 Tanaka et al. ..... 345/95

FOREIGN PATENT DOCUMENTS

GB 2312542 10/1997
WO 9723863 7/1997

*Primary Examiner*—Regina Liang
(74) *Attorney, Agent, or Firm*—Renner, Otto, Boisselle & Sklar

(57) ABSTRACT

The invention relates to multiplex addressing of a liquid crystal device comprising applying a strobe signal to one of a first plurality of electrodes of the device and a data signal to one of a second plurality of electrodes of the device. The strobe and data signals address a pixel of the device. The data signal comprises one of a SELECT data signal and a NON_SELECT which each have a duration and a discriminating duration which is no longer than the duration. During the discriminating duration the SELECT and NON_SELECT signals are different. The strobe signal comprises a first portion applied simultaneously with the discriminating duration of the data signal and a second portion applied after the discriminating duration of the data signal. By including a section at a larger voltage magnitude in the second portion of the strobe signal than is present in the first part of that signal, improved performance and addressing speed are obtainable. The Figure shows the four possible combinations of data signal over two addressing periods on the left hand side and a strobe signal in accordance with the invention at the top. The figure shows that SELECT resultant signals A and B closely match the ideal waveshape for fast change of state while the NON_SELECT resultant signals C and D give good discrimination.

47 Claims, 21 Drawing Sheets

Effect of reverse bias on FLC director profile

ADDRESSING METHOD AND APPARATUS

TECHNICAL FIELD OF THE INVENTION

The present invention relates to an addressing method and apparatus for liquid crystal devices having particular, but not exclusive, application to large area ferroelectric liquid crystal devices.

BACKGROUND OF THE INVENTION

Liquid crystal display and shutter devices have been known for many years for use in calculators, computer displays and so on. One well known type of display uses a twisted nematic liquid crystal in which liquid crystal molecules are induced by a pair of substrates to form a spiral having an axis perpendicular to the pair of substrates which contain the liquid crystal. Electrodes arc arranged on the substrates and applying a voltage, via these electrodes, across the liquid crystal causes the liquid crystal molecules to "unwind". Since the molecules are optically active the polarisation of any light passing between the substrates is altered when the molecules form a spiral. By using a polariser on the substrates of the device, light and dark states may be provided dependent upon whether the voltage is applied or not.

Two major disadvantages with twisted nematic liquid crystal devices are that the speed of response is low and that the molecules relax (albeit quite slowly) to a single stable position when the drive voltage is removed. In a large area display device, some form of multiplexing is required to address the large number of liquid crystal pixels because individual electrical connections to drive each pixel are not possible. Since the molecules relax back to their stable state in the absence of a drive voltage, they must be addressed at frequent intervals if the contrast of the display is to be adequate. The rate at which the whole array can be addressed is therefore limited. In addition, the response speed of nematic liquid crystal displays makes them generally unsuitable for displaying moving images (i.e. video rate).

A faster response may be provided by liquid crystal display and shutter devices based upon ferroelectric liquid crystal materials. These are generally very thin devices in which the spontaneous helix of the chiral smectic phase is retained in an "unwound" state by the physical restriction of closely-spaced substrates. By selection of liquid crystal material, the state of the material and physical dimensions, a device which exhibits bi-stability may be provided. When a voltage of a first polarity is supplied across such a liquid crystal device the liquid crystal molecules adopt a first position or state provided that the time and voltage product ($\tau V$) is above a certain threshold. When a voltage of the opposite polarity is applied (and also above the $\tau V$ threshold), the molecules adopt a second position or state. The molecules are optically active so, using polarisers, these two positions can give different states of optical transmission. The molecules, or more properly the director, will remain in the adopted positions until a voltage of the opposite polarity is applied. Such devices, as well as exhibiting bi-stability, also offer a faster response than twisted nematic devices. Both of these characteristics makes liquid crystal devices based on ferroelectric liquid crystals attractive for use in large area liquid crystal array devices (be they displays, shutters and so on).

Typically, electrodes will be arranged on the two substrates of the device in respective orthogonal directions to form a matrix of picture elements called pixels. The points at which the electrodes on a first substrate (row electrodes) cross those on a second substrate (column electrodes) define the pixel elements of the array. Some form of multiplexing must be used to address such a device. A common technique is to apply a blanking signal followed by a strobe signal to all of the rows of the device in succession. The blanking signal is arranged to ensure that all of the pixels in a row adopt the same state (typically dark) irrespective of the data signal applied to the columns. Then, a strobe signal is applied to a row electrode while the states of the pixels in that row are altered as appropriate using a number of data signals applied to the column electrodes. One of two data signals is usually provided to each column electrode, a SELECT data signal which causes the addressed pixel to change state and a NON_SELECT data signal that causes the pixel to remain in the same state in other words the state induced by the blanking signal. The strobe signal is applied to each row for a long enough period of time to permit the ferroelectric liquid crystal material at each pixel to adopt the desired state and then the strobe signal is applied to the subsequent row. The data signals applied to the columns of the device are then altered to correspond with the desired states of the pixels in that subsequent row. The time required, therefore, to address the whole array is equal to the strobe signal application time (per row) multiplied by the number of rows in the array. Further details can be found in UK patent publication number GB 2,232,802.

The term "strobe signal" is issued to refer to that portion of a signal applied to a first electrode of a device which, in co-operation with a particular signal applied to a second electrode, provides discrimination between the states adopted by an addressed pixel. The strobe signal may include portions before and after the duration of the particular signal applied to the second electrode.

As the size and resolution of the display or shutter devices increases, the number of rows increases and/or the frame rate (for example that set by a requirement for no-flicker) may be such that the ferroelectric liquid crystal material has insufficient speed to be addressed whilst maintaining discrimination between the bistable states across the device.

A partial solution to this problem, is to address the array in two halves. Two sets of column electrodes are provided which extend from opposite edges of one of the substrates. Two strobe signals are applied at any given time, one strobe signal to one half of the array and the other strobe signal to the other half of the array. Because two rows of the array can be addressed simultaneously the frame rate is effectively doubled. The main drawback of such an arrangement is that the addressing circuitry for providing the data (column) signals has to be duplicated. Providing interrupted column electrodes and the extra connections to the addressing circuitry also increases the expense of the arrangement.

Another problem is temperature. A liquid crystal material may operate sufficiently quickly at some temperatures but if the temperature of the device is lower, the material is slower and the frame rate cannot be maintained. This may be cured to some extent by extending the strobe signal into the following lines still further (as in United Kingdom Patent Publication GB 2,262,831) but this reduces the temporal/voltage operating range for some data patterns in the following lines. Thus, there is a limit to which the strobe may be extended and hence temperature of operation compensated for.

For a large area display there may be significant variations of temperature, alignment quality, pixel pattern switching history and/or voltage (signal shape and magnitude, for example caused by line transmission problems). Another problem is limited operating range (for example in time/voltage) over which discrimination between the select and non_select resultant signals deteriorates. This can mean that operation does not occur uniformly across the whole panel and the two bistable states may not be obtained reliably.

SUMMARY OF THE INVENTION

It is an object of the present invention to provide an addressing method and apparatus for a liquid crystal device which ameliorate these disadvantages.

According to the first aspect of the present invention, there is provided a method of addressing a liquid crystal device comprising applying a first signal to one of a first plurality of electrodes of the device and applying a second signal to one of a second plurality of electrodes of the device which first and second signals address a pixel of the device, the second signal comprising one of at least a first data signal and a second data signal which first and second data signals are different from each other and each have a duration and a discriminating duration, which is no longer than the duration, during which discriminating duration the first data signal differs from the second data signal, wherein the first signal comprises a first portion applied during the discriminating duration of the second signal and a second portion applied after the discriminating duration of the second signal which second portion of the first signal includes a section at a larger voltage magnitude than the first portion of the first signal.

It has been appreciated that ferroelectric (and also antiferroelectric or AFL) liquid crystal devices may be addressed by a combination of strobe and data signals in which only an earlier portion of the combined signal differs for SELECT and NON_SELECT of the pixel allowing the next line or lines to be addressed before complete latching of the pixels of the first line. Prior attempts to use such techniques have resulted in poor discrimination between the combined signals for the SELECT and NON_SELECT cases, in other words a reduction in confidence that the state adopted by a pixel is the state requested by the applied data signal. This is commonly the result of changes in temperature, applied voltage, alignment of the liquid crystal and so on.

It has now been appreciated that improvements in one or more parameters (such as an increase in the addressing speed ) can be obtained without such a serious reduction in the discrimination. This is achieved by increasing the voltage of the strobe signal (first signal) applied to a row of the device once (or some time after) the discriminating SELECT or NON_SELECT part of the data signal (second signal) for that row is no longer applied to the column electrodes. This can be used to enhance the frame rate by reducing the amount of time that each row needs to be addressed with its respective data signals. Alternatively or in addition, the problem of poor discrimination between SELECT and NON_SELECT states of pixels is reduced by the section of the strobe signal having a larger voltage magnitude for reasons discussed more fully below.

The present invention also relates to a corresponding addressing arrangement and a liquid crystal device comprising such an arrangement.

According to a second aspect of the present invention, there is provided an apparatus for addressing a liquid crystal device comprising means for applying a first signal to one of a first plurality of electrodes of the device and means for applying a second signal to one of a second plurality of electrodes of the device which first and second signals address a pixel of the device, the second signal comprising one of at least a first data signal and a second data signal which first and second data signals are different from each other and each have a duration and a discriminating duration which is no longer than the duration, during which discriminating duration the first data signal differs from the second data signal, wherein the means for applying the first signal is arranged to provide a first signal comprising a first portion applied during the discriminating duration of the second signal and a second portion applied after the discriminating duration of the second signal which second portion of the first signal includes a section at a larger voltage magnitude than the first portion of the first signal.

According to a third aspect of the present invention there is provided a liquid crystal device comprising an array of electrodes arranged on substrates for containing a liquid crystal, means for applying a first signal to one of a first plurality of electrodes of the device and means for applying a second signal to one of a second plurality of electrodes of the device which first and second signals address a pixel of the device, the second signal comprising one of at least a first data signal and a second data signal which first and second data signals are different from each other and each have a duration and a discriminating duration which is no longer than the duration, during which discriminating duration the first data signal differs from the second data signal, wherein the means for applying the first signal is arranged to provide a first signal comprising a first portion applied during the discriminating duration of the second signal and a second portion applied after the discriminating duration of the second signal which second portion of the first signal includes a section at a larger voltage magnitude than the first portion of the first signal.

Usually the liquid crystal will be a liquid crystal mixture comprising at least one liquid crystal-forming compound.

In an embodiment of the invention, a strobe signal will be applied simultaneously to at least two consecutive rows of the device. During the second (or "extended") portion of the strobe signal, the pixels of the row to which it is applied will also be subjected to the data signals intended for the pixels of the following row. Clearly, these signals will not necessarily be the correct ones for the pixels of the row to which the extended portion of the strobe signal is applied. The present invention is based on a study of the performance characteristics of ferroelectric liquid crystal and a realisation that by modifying a second or extended portion of the strobe signal, the effect of the data signals applied to the pixels of that row during that extended portion can be minimised. Thus the line address time of the device which is equal to the frame rate divided by the number of rows can be shortened. The time taken to address the whole array is consequently reduced or the temperature range for a given frame rate can be extended.

In one embodiment of the present invention, the whole of the second portion of the first (strobe) signal may have a higher voltage amplitude than the initial portion.

Part of the second portion of the first (strobe) signal may be altered to provide a temperature compensation for the liquid crystal device. This may entail making the second portion of the strobe signal include a portion at a lower voltage than the highest voltage of the second portion or even the highest voltage of the first portion of the signal. This lower voltage portion can also provide improved discrimination for the device.

The duration of the second portion of a strobe signal may be varied within the scope of the invention. If the second portion is arranged to be no longer than a line address time (L.A.T) then the driving circuitry for the strobe signal needs only to provide a strobe signal to two of the rows of the device simultaneously. However, the second portion of the strobe signal may be lengthened beyond one line address time in order to provide a higher addressing speed, improved discrimination, temperature compensation or any combination of these. Limiting the second portion to one L.A.T. can provide a simplification in the strobe signal driving circuitry.

According to an embodiment of the present invention, the second portion of the first (strobe) signal is arranged to approximate an optimum switching voltage signal for the liquid crystal independent of the data signal applied. Some compromise is necessary here, since the second (data) signal applied to the subsequent row(s) is not constrained.

In a preferred embodiment of the present invention, the line address time of the addressing method or apparatus is arranged to be less than the latching time of the ferroelectric liquid crystal material.

In a further embodiment of the invention, at least a portion of the strobe signal is arranged to be a continuously varying signal, for example the second portion of the strobe signal.

Further preferred features of the present invention are set out in appended dependent claims.

BRIEF DESCRIPTION OF THE DRAWINGS

The present invention will now be described, by way of example, with reference to the accompanying drawings, in which:

FIG. 2(*b*) shows a graph of experimentally derived time ($\tau$) against voltage (V) results for another ferroelectric liquid crystal device;

FIG. 5(*b*) shows a diagrammatic graph of time ($\tau$) against temperature (T) for addressing schemes of the type shown in FIG. 4;

FIG. 8(*b*) shows a graph of in plane twist of the director with distance from the substrates at various applied voltages;

FIGS. 20(A) to (D) show data and corresponding strobe signals of the prior art while FIGS. 20(E) to (W) show strobe signals in accordance with the invention when combined with the particular data signals shown in (A) and (B);

DETAILED DESCRIPTION OF THE INVENTION

Figure 1:
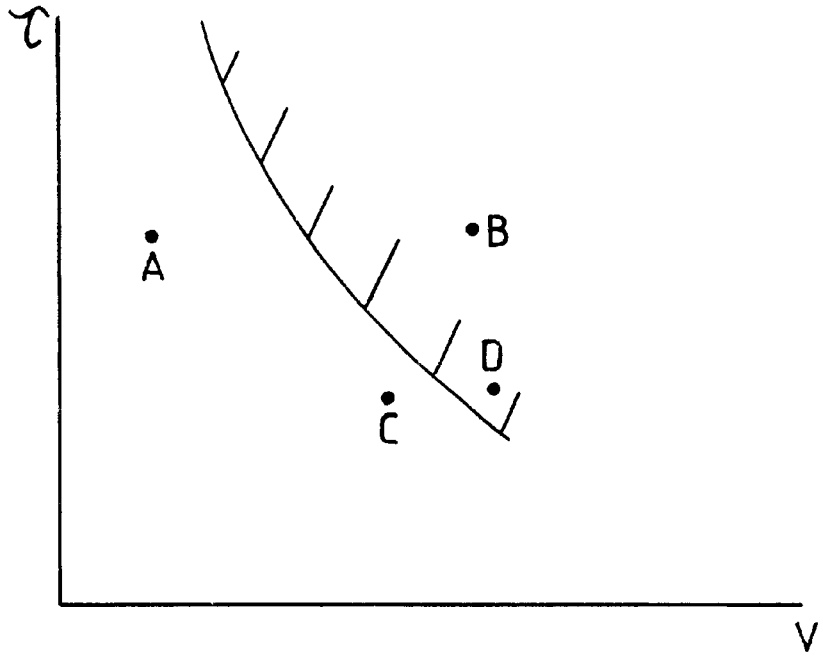
FIG. 1 PRIOR ART
FIG. 1 shows a graph of time ($\tau$) against applied voltage (V) for a ferroelectric liquid crystal device.

FIG. 1 shows a diagrammatic operating curve of duration of applied pulse ($\tau$) against voltage (V) for so-called "standard" operation of a ferroelectric liquid crystal device. If it is assumed that the molecules (represented by an average molecular direction termed the director) of the device occupy a particular state then the graph indicates combinations of applied voltage and time required to cause them to adopt the other state (assuming that signals of the correct polarity are applied). Combinations of $\tau$ and V which lie above and to the right of the curve (shaded side) shown in FIG. 1 will cause the pixel to change state and remain in that state when the applied voltage is removed (in other words latch). Combinations of $\tau$ and V which fall to the left and below the curve will not change the state of the pixel. The application of a higher voltage (to some extent) causes the liquid crystal directors to change states more quickly. By increasing the voltage applied to a ferroelectric liquid crystal array, therefore, faster operation may be obtained.

The graph is simplified somewhat because the operating curve is not an infinitely thin line. Not all of the molecules in a pixel (much less a whole display panel) change state for exactly the same applied signals. Consequently, there is a curve corresponding to the start of the switching process within a pixel (often called the first speckle) and another one a short duration or voltage away which corresponds with the whole of the pixel having changed state. The operating curve thus has a finite width sometime called the partial switching region. (See, for example FIG. 2(*b*) discussed below).

However, ferroelectric liquid crystal materials are very sensitive to temperature variations and application of higher voltages to a ferroelectric liquid crystal device causes larger dissipations of power in the electrodes of the device. This causes the temperature of the device to rise and the operating curve moves. In a liquid crystal array addressed in a multiplexed manner the problem is exacerbated because the column electrodes are constantly subjected to addressing signals (data signals) which have a heating effect. Consequently, it is desired to arrange for the data signals to have as small an amplitude as possible which leads to a tighter specification being placed on the strobe signal.

However, a small data voltage leads to the problem of discrimination between pixels which are required to change state and those which are required to remain in the same state. In a multiplexed array device the same strobe signal is applied to all of the pixels in the row while SELECT and NON_SELECT data signals provide the discrimination between pixels which are to change state and those which are not to change state. The combination of the strobe signal and a NON_SELECT data signal must therefore lie to the left of the curve while the combination of the strobe signal and a SELECT data signal must lie to the right of the curve. Because the operating curve has a finite width due to different behaviour of the molecules within a pixel, large data signal voltages would appear to assist in providing good discrimination. The variation of parameters such as temperature, alignment and applied voltage over the array (which moves the whole curve relative to the axes) also encourage large data signal voltages. As stated above, however, it is desirable to make the data signal voltages as small as possible because these are applied continually to the column electrodes of the array, since this forms a major contribution to the power dissipated by a liquid crystal array. For example if the data signals have large voltages, this causes undesirable heating of the array with the consequences discussed.

Consider the points A and B in FIG. 1. Point A corresponds to a voltage of a combination (or resultant) of a strobe voltage $V_s$ minus a data voltage $V_d$, $(V_s-V_d)$, while point B corresponds to a resultant of a strobe voltage $V_s$ plus a data voltage $V_d$, $(V_s+V_d)$. Point A provides a NON_SELECT resultant signal while point B provides a SELECT resultant signal. Such combinations or resultant signals would be expected to provide good discrimination since points A and B lie well clear (on their respective sides) of the operating curve. Even if the curve moves (due to heating of the device, for example) signals corresponding to the points A and B will still lie on the correct sides of the curve and provide correct behaviour. However, large values of voltage $V_d$ for the data signal are required.

If a smaller value of $V_d$ is used then, for example the situation illustrated at points C and D arises. Point C corresponds to a NON_SELECT resultant signal, $(V_s-V_d)$, while point D corresponds to a SELECT resultant signal, $(V_s+V_d)$. The smaller voltage values of the data signals are efficacious at limiting the heating power applied to the device. However, external factors (for example a source of back lighting or ambient temperature) may still alter the temperature of the device. This causes the operating curve shown in FIG. 1 to move and so the discrimination provided by an addressing scheme corresponding to points C and D will not operate correctly since the curve does not have to move very far before both point C and point D lie on the same side of the line.

Figure 2A:
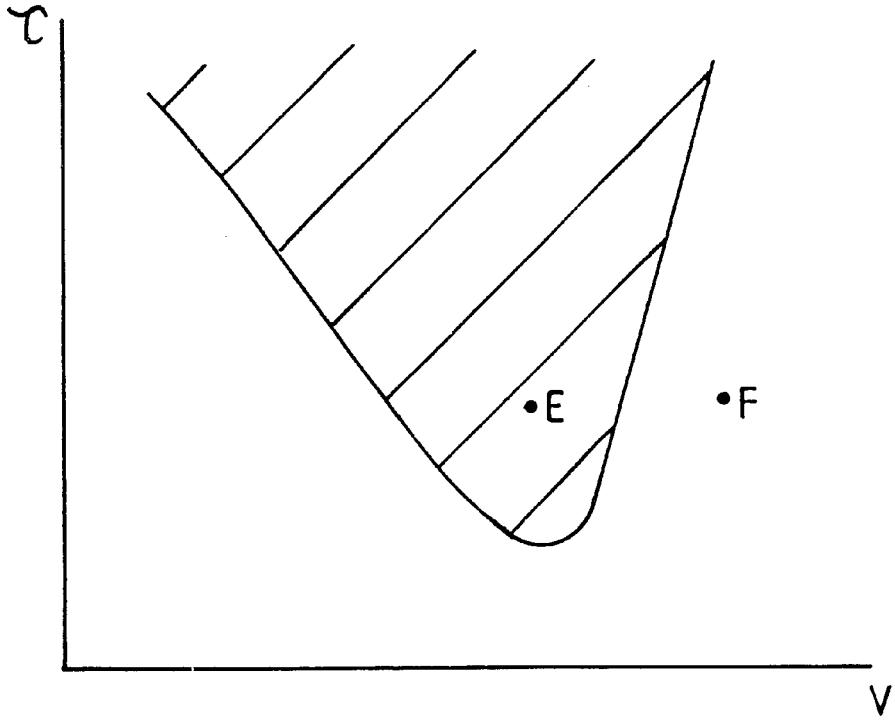
FIG. 2(a) PRIOR ART
FIG. 2(*a*) shows a graph of time ($\tau$) against voltage (V) for another ferroelectric liquid crystal device.
Figure 2B:
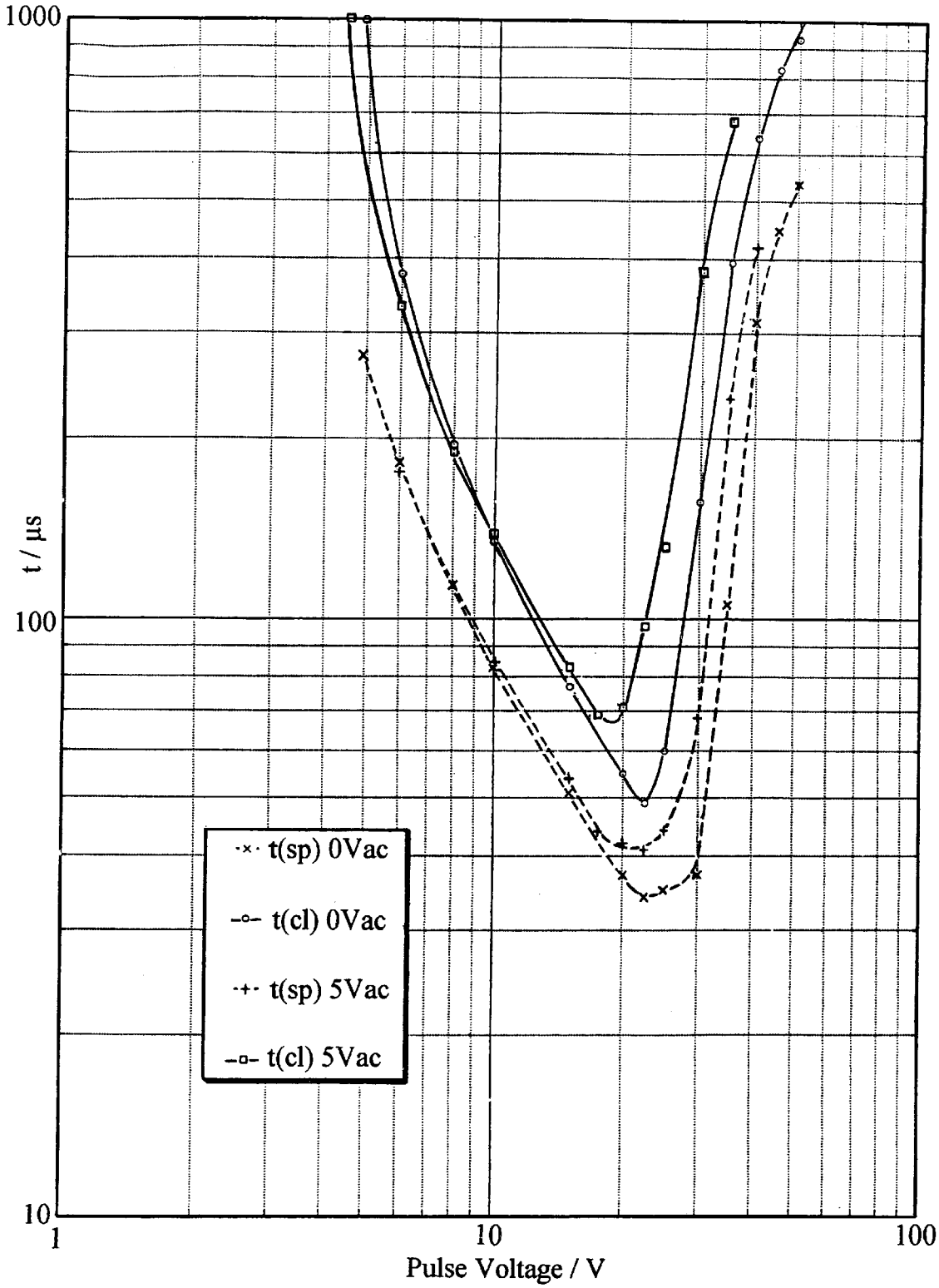
FIG. 2(b) PRIOR ART

A proposed solution to this problem is so-called "inverted operation" illustrated by the operating curve in the $\tau V$ graph of FIG. 2(*a*). This is described in greater detail in 'The "JOERS/Alvey" Ferroelectric Multiplexing Scheme' by Surguy et al. and published in Ferroelectrics, 1991, Vol. 122, pp. 63–79. This is also described in United Kingdom published patent specification GB 2146743A. This inverted operation is provided by using ferroelectric liquid crystal materials with a relatively small value of spontaneous polarisation ($P_s$) and/or relatively highly positive dielectric biaxiality ($\partial\in$). This results in a small value of the quotient $P_s/\in_o d\in$ and causes a knee, corner or turnaround to occur in the curve. Thus, it can be seen that after a certain point an increase in the voltage applied actually increases the length of the pulse required to latch a pixel into the other state. The reason why this occurs will be explained below. In addition, the operating curve is much steeper over the inverted portion to the right of the "knee".

The shaded area within the curve corresponds to SELECT (i.e. to changing the state of a pixel) while the remainder corresponds to NON_SELECT (the pixel remaining in its original state). The points E and F correspond to combinations of strobe and data signal voltage $V_s-V_d$ and $V_s+V_d$ respectively, in a similar manner to the points in FIG. 1. However, in this case the point F corresponds to the NON_SELECT operating point while the point E is the SELECT operating point. The NON_SELECT operating point has a higher value of voltage than the SELECT operating point and this is why this is called inverted operation. This provides improved discrimination because of the steeper gradient of the inverted portion of the curve.

FIG. 2(*b*) shows a graph similar to that of FIG. 2(*a*) but derived from experimental results. Two sets of partial swicthing curves are shown for no AC stabilisation and for AC stabilisation applied at 5V ac. The results for no AC stabilisation (multply signs and circles) are not discussed here because these are not practical for a multiplexed array that has data signals applied all of the time. One of the remaining two curves (with plus signs) is the curve representing the start of switching. This is also called the first speckle curve and is hence shown on the graph as (sp). The other curve (with open squares) is the curve representing the completion of switching. This is shown on the graph as (cl).

Figure 3:
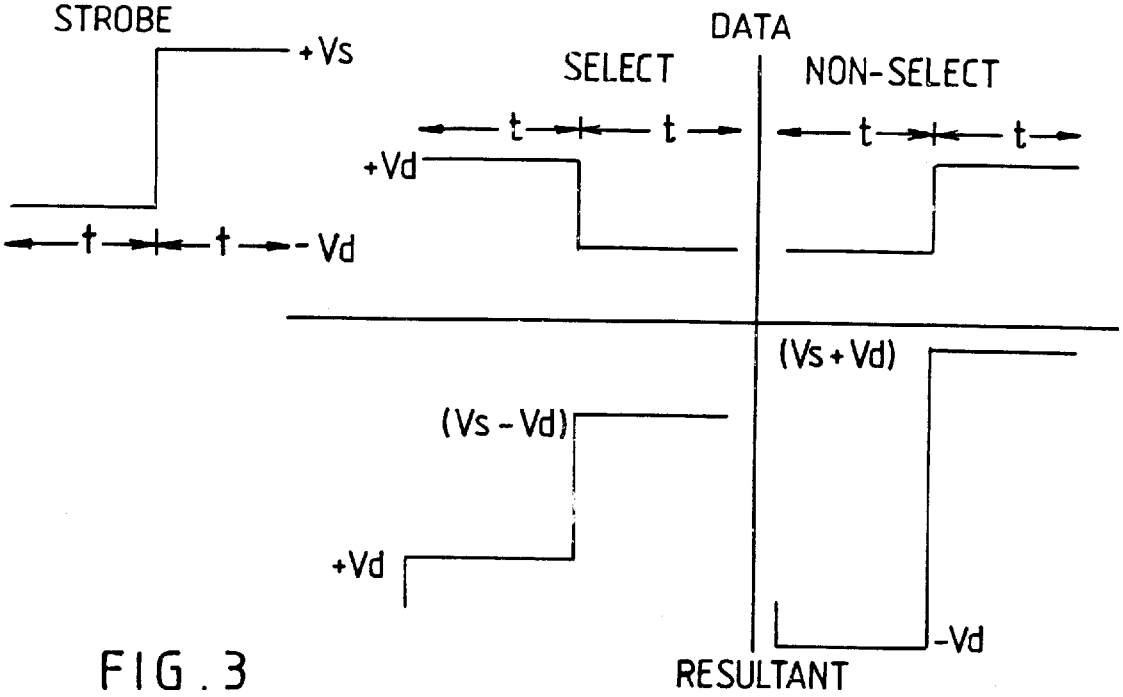
FIG. 3 PRIOR ART
FIG. 3 shows prior art strobe, data and resultant signals.

FIG. 3 shows strobe and data signals according to the JOERS/Alvey prior art addressing scheme referred to above. The STROBE signal comprises zero volt for a duration t followed by $V_s$ volt for an equal duration t. A SELECT data signal comprises $+V_d$ volt for duration t followed by $-V_d$ volt for an equal duration t. A NON_SELECT data signal comprises $-V_d$ volt for a duration t followed by $+V_d$ volt for an equal duration t. Since these signals are applied in combination across a liquid crystal pixel they effectively subtract and the RESULTANT signals are as shown (resultant=strobedata). The SELECT resultant signal comprises a voltage $+V_d$ for duration t followed by voltage $(V_s-V_d)$ for duration t. The NON_SELECT resultant signal comprises a voltage $-V_d$ for duration t followed by voltage $(V_s+V_d)$ for an equal duration t. After the second duration t the STROBE signal is reduced to zero and the same signal applied to a following line of the array. Each line is therefore addressed for a time equal to 2t and this is referred to as the line address time (L.A.T.) The STROBE signal in this example does not extend beyond a single line address time.

Figure 4:
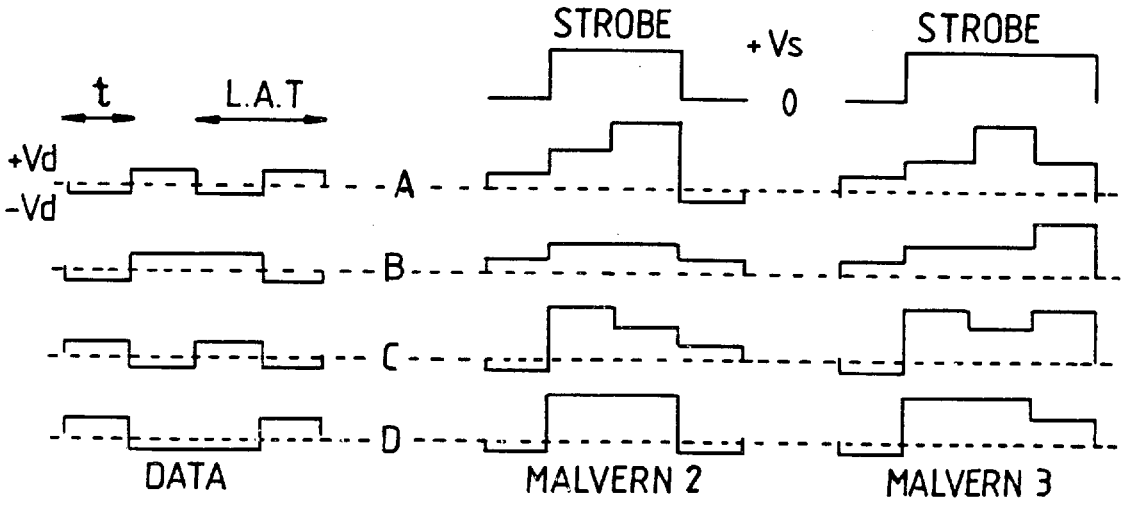
FIG. 4 PRIOR ART
FIG. 4 shows further prior art strobe, data and resultant signals.

FIG. 4 shows data and strobe signals for a prior art addressing scheme in which the strobe signal is extended beyond one line address time (L.A.T.). In the MALVERN 2 arrangement, the strobe signal is extended by one half of L.A.T. and in the MALVERN 3 arrangement the strobe signal is extended by a complete L.A.T. Within a single L.A.T. the data signal is either $-V_d$ for a duration t followed by $+V_d$ for a further duration of t or the inverse of this signal. The state of the addressed pixel is determined by which of the two data signals is applied. With a positive-going strobe signal, a data signal of $-V_d$ followed by $+V_d$ will result in a pixel remaining in a first state (for example black), while a data signal of $-V_d$ followed by $+V_d$ will result in the pixel changing state (for example to white). Usually a blanking signal is applied to the rows of the array shortly before the strobe signal is applied. The purpose of the blanking signal is to set all of the pixels in a particular row to one state (typically black) irrespective of applied data. (Since the blanking signal occurs several lines ahead of the strobe signal and so the pixels receive data pulses for some of the preceding lines which may or may not assist the blanking signal). Then when the strobe signal is applied, those pixels which are required to be white can then be switched while those which are required to be black are left unswitched. As an alternative to a blanking signal, two strobe signals may be applied, firstly to switch pixels to white and secondly to switch pixels to black as required. Since this arrangement is more time consuming, a blanking signal is usually employed.

The strobe signal in the MALVERN 2 addressing scheme is shown at the top of the figure. It comprises a duration t of zero volts followed by a duration of 2t having a voltage of $+V_s$. The data signals, in combination with this strobe signal provide resultant signals shown in the MALVERN 2 column of the figure at rows A, B, C and D. Since the strobe signal extends into the line address time of the following row, the data signals applied to the array for addressing the following row must be considered. These data signals can of course be either the SELECT (white) or the NON_SELECT (black) data signals. Thus, there are four combinations to consider. Data signal A corresponds to a white pixel in the addressed row followed by a white pixel in the following row. Data signal B corresponds to a white pixel in the addressed row followed by a black pixel in the following row. Data signal C corresponds to a black pixel in the addressed row followed by a black pixel in the following row. Data signal D corresponds to a black pixel in the addressed row followed by a white pixel in the following row. When these data signals are combined with the MALVERN 2 strobe signal the resultant signals are as shown at A, B, C and D (middle column of the figure).

The data signal A provides a SELECT resultant signal in which the addressed pixel is switched to white. The data signal B also provides a SELECT resultant signal but, as will be described below, this is rather less satisfactory. The data signals C and D provide NON_SELECT resultant signals.

The MALVERN 3 strobe signal and resultant signals are shown in the right-hand column of the figure. The effects of resultant signals derived from data signals A, B, C and D are the same as for the MALVERN 2 strobe signal. The MALVERN strobe signals, however, suffer from the drawbacks described below. Further extensions of the strobe signal (to MALVERN 4, MALVERN 5, etc.) are possible but suffer even more from the drawbacks described below. Intermediate durations of strobe signal are possible such as MALVERN 0.5 and MALVERN 1.5, see for example published International Patent Application WO95/24715.

Figure 5A:
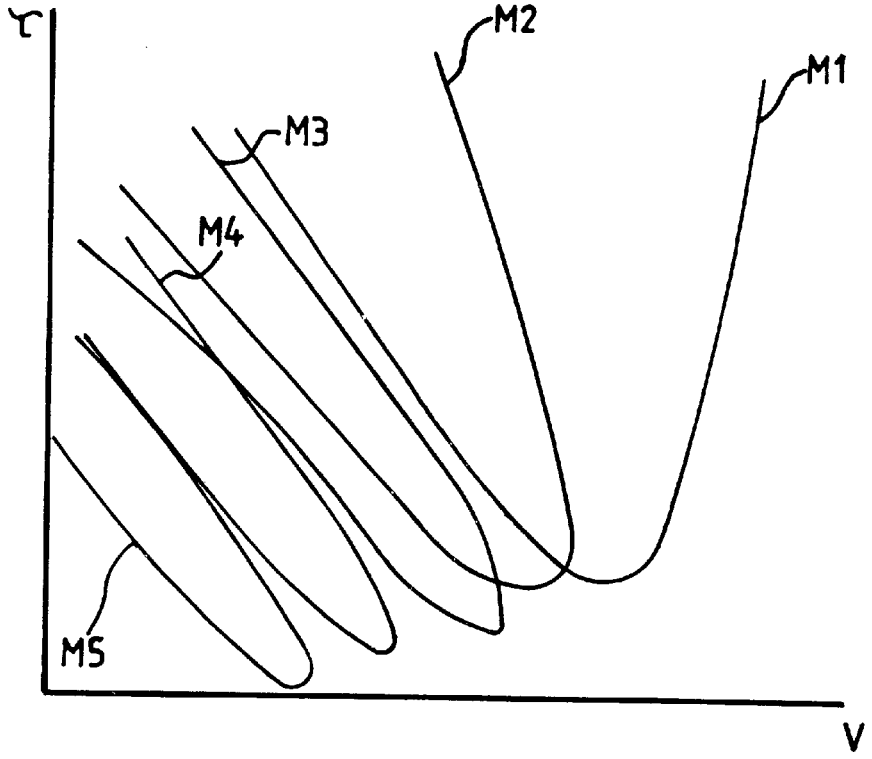
FIG. 5(a) PRIOR ART
FIG. 5(*a*) shows a diagrammatic graph of time ($\tau$) against voltage (V) for addressing schemes of the type shown in FIG. 4.
Figure 5B:
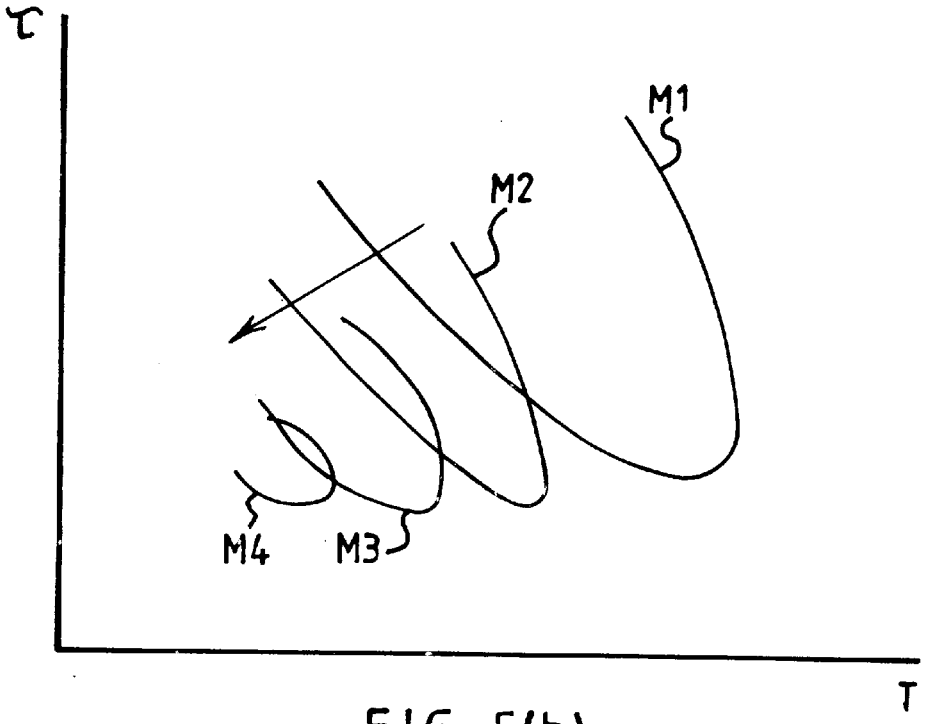
FIG. 5(b) PRIOR ART

FIG. 5(*a*) shows a diagrammatic graph of the switching time (τ) against applied voltage (V) for a number of such extended strobe signal (MALVERN) addressing schemes. The curve M1 illustrates the operating curve for a strobe signal which does not extend beyond application of the relevant data signal for a particular pixel. The curve M2 corresponds with the MALVERN 2 addressing scheme discussed above. Likewise, the curves M3, M4 and M5 correspond with MALVERN 3, MALVERN 4 and MALVERN 5 addressing schemes respectively. As can be seen from the graph, the greater the extension of the strobe signal, the faster the switching, and the lower is the minimum voltage applied. However, the areas defined by the curves (the SELECT area) become narrower and narrower as the amount of strobe signal extension increases (see also corresponding figures in the above-identified patent application). This means that the discrimination between SELECT and NON_SELECT becomes too small for satisfactory operation or even non-existent.

FIG. 5(*b*) shows a diagrammatic graph of the minimum latching time (τ) against temperature for fixed strobe and data voltages. Higher order strobe extensions become unavailable at high temperature.

The present invention addresses this problem by providing at least a section of the extended portion of the strobe signal at a higher voltage than the earlier portion of the strobe signal which is applied simultaneously with the second (data) signal. The reason that this provides improved discrimination is discussed below.

Figure 6:
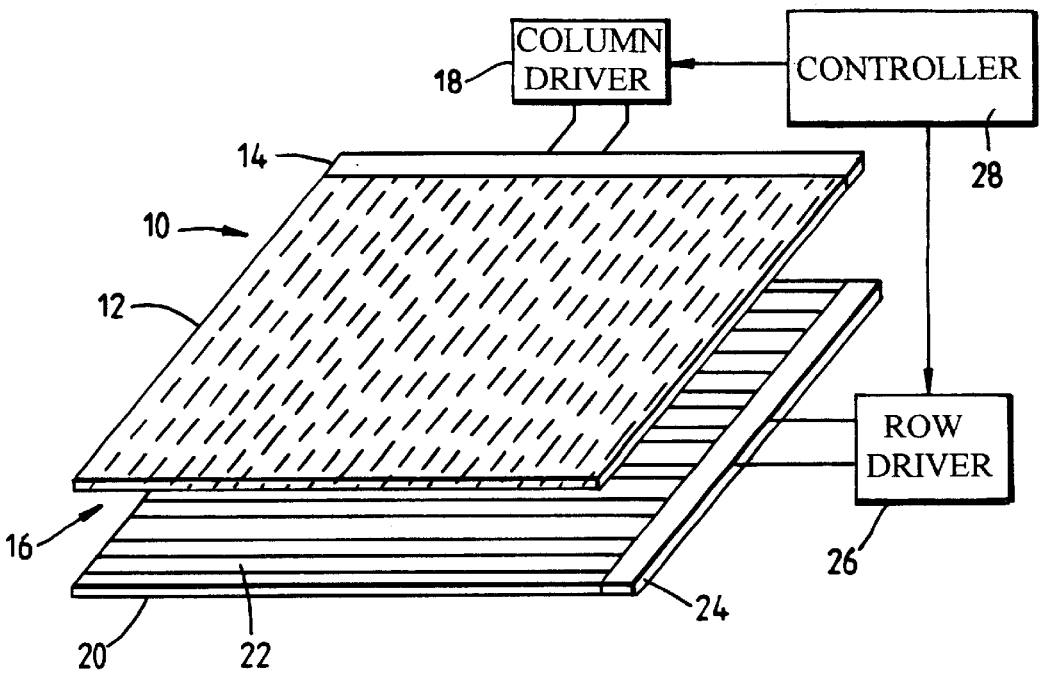
FIG. 6 shows a schematic diagram of a liquid crystal device array to which the present invention may be applied.

FIG. 6 shows a passive ferroelectric liquid crystal array device 10, for example a liquid crystal display device, comprising a first transparent substrate 12 and a second transparent substrate 20 spaced apart from the first substrate by known means such as spacer beads (not shown). The substrate 12 carries a plurality of electrodes 16 of transparent tin oxide on that surface of the substrate that faces the second substrate 20.

The electrodes 16 are arranged parallel to one another and each extend between a first edge of the substrate 12 and a second edge at which an electrical connector 14 is arranged to connect each electrode to a column driver 18. The substrate 20 carries a plurality of transparent electrodes 22 also arranged in parallel with one another but at right angles to the electrodes 16 on the first substrate. The electrodes 22 extend from a first edge of the substrate 20 to a second edge at which an electrical connector 24 connects them to a row driver 26. Both the row driver 26 and the column driver 18 are connected to a controller 28 which will typically comprise a programmed microprocessor or an application specific integrated circuit (ASIC). Other electrode configurations can be applied to the liquid crystal device to provide, for example, a seven segment display, an r,θ display and so on. The liquid crystal device will also comprise optical polarising means and alignment layers (not shown) as is known to those skilled in the art. The device may include a light source or reflector for transmissive or transflective operation as is known in the art. A polariser may be provided at each of the substrates of the device or a single polariser provided in conjunction with a polarising dye placed in the liquid crystal. Alternate electrodes on each substrate of the device may be connected to the row and column drivers at opposite edges of the substrates. The device may further include other optical elements such as a diffuser, colour filters, microlenses etc. The operation of the device will be described in greater detail below.

Figure 7:
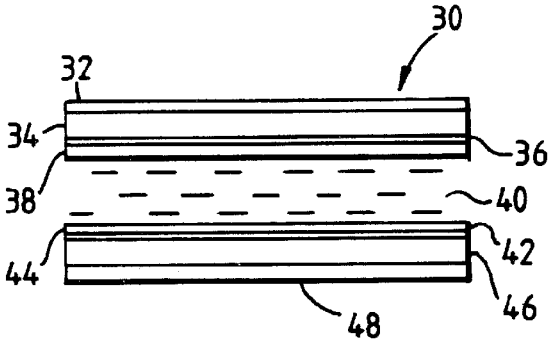
FIG. 7 shows a side view of a part of the device shown in FIG. 6.

FIG. 7 shows a simplified cross section of a passive ferroelectric liquid crystal device in which features such as barrier layers, colour filters and so on are omitted for clarity. A single pixel 30 of the device 10 (FIG. 6) is shown in elevation and comprises, in order from the top of the figure downwards: polariser 32, transparent substrate 34, electrode structure 36, alignment layer 38, liquid crystal layer 40, alignment layer 42, electrode structure 44, transparent substrates 46 and polariser 48. The liquid crystal layer will typically be between 1.5 $\mu$m and 2 $\mu$m in height for a ferroelectric device. The polarisers are arranged to allow the different states of the liquid crystal to be observed. The alignment layer will typically be a rubbed polyimide layer as is known in the liquid crystal and FLC art. Such a layer may be spun down onto the substrates of the device after the formation of the electrode structures and the layer rubbed consistently in one direction using a soft cloth or other material. This provides the surface stabilisation of the surface stabilised ferroelectric liquid crystal device (SSFLCD). The direction of rubbing applied to the two substrates may typically be parallel to one another but facing in opposite directions. Other techniques for alignment such as evaporation of a dielectric, a photo-alignment technique or gratings may be employed. The pixel is defined as the intersection of one of the column electrodes and one of the row electrodes of the array. To use the device as a display it will typically be back-lit by a light source to provide a transmissive mode of operation although a mirror may be provided in one of the substrate structures to allow operation in a reflective mode.

Figure 8A:
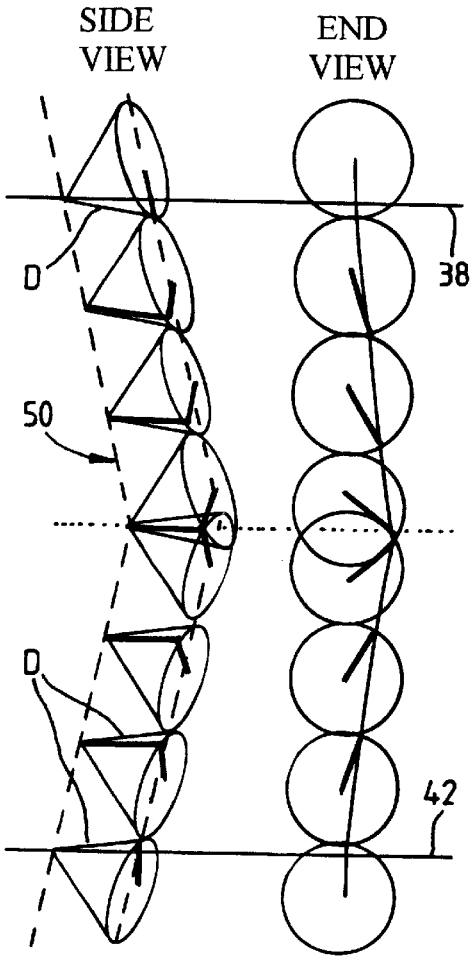
FIGS. 8(*a*) and 8(*c*) show diagrammatic views of a number of smectic layers of ferroelectric liquid crystal together with director profiles between a pair of substrates.
Figure 8C:
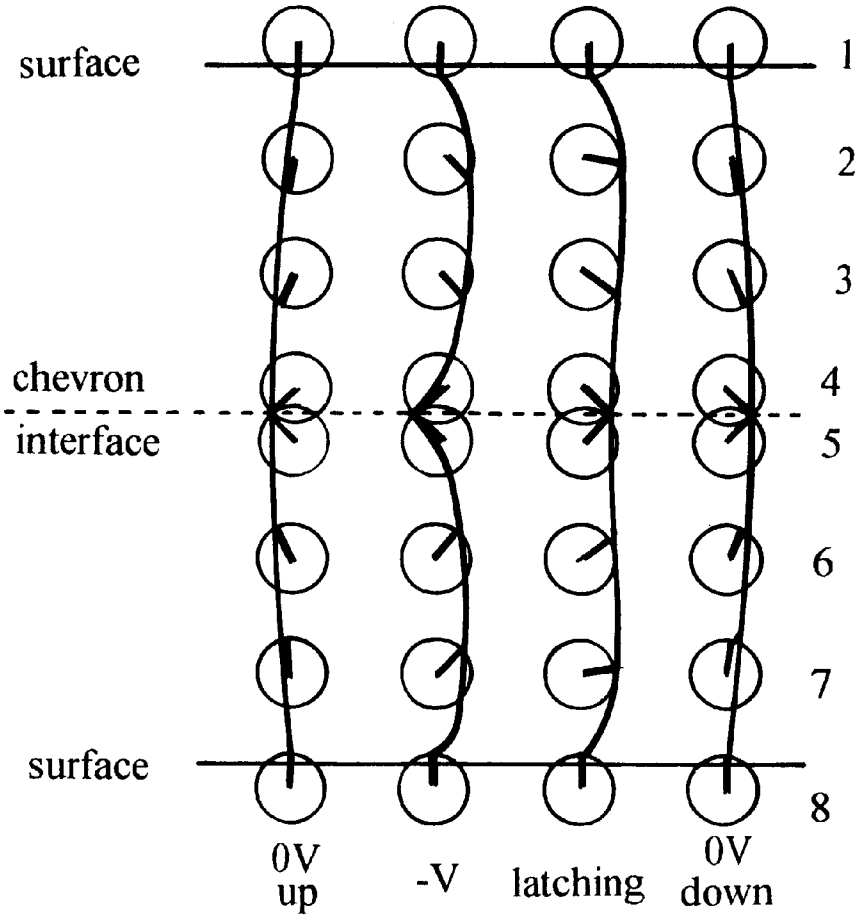
Figure 8B:
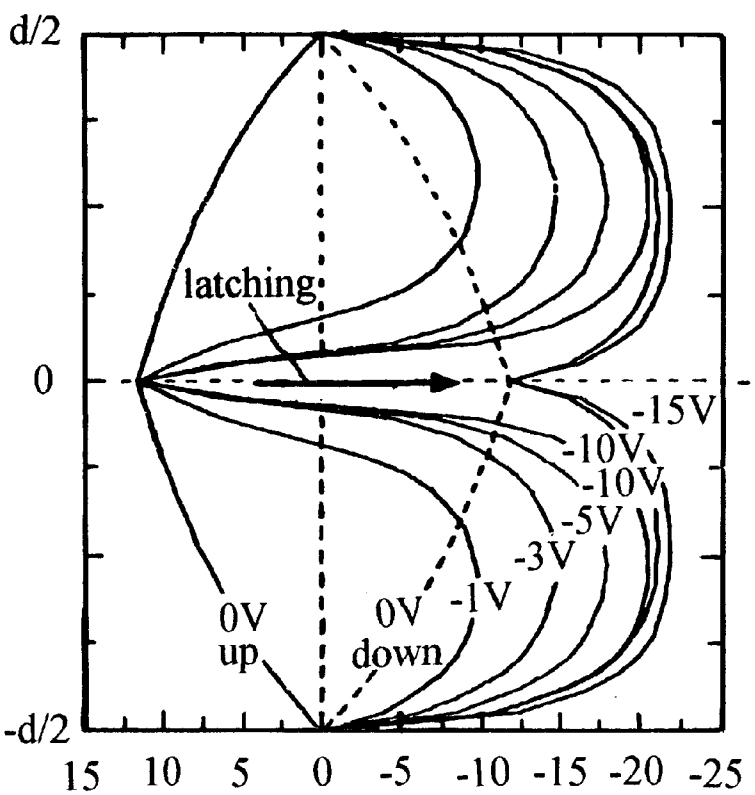

FIG. 8(*a*) shows a diagrammatic representation of side and end views of ferroelectric liquid crystal molecules or Directors D in a thin pixel such as that shown in FIG. 7 with the rubbing directions of the alignment layers parallel. The example shows a liquid crystal in a smectic C* phase with C2 alignment but the invention is equally applicable to an FLCD in which the liquid crystal is in the smectic C* phase with C1 alignment or in bookshelf uniform tilted layers and so on. Such liquid crystal devices are treated to arrange the liquid crystal in a smectic phase by heating the device during and after it is filled with the liquid crystal. The liquid crystal flows freely into the device while in an isotropic phase and is then cooled slowly through a cholesteric phase and a nematic phase to the optically active smectic C* phase. A variety of liquid crystal materials are known which exhibit an optically active smectic C* phase at ambient temperatures. A ferroelectric liquid crystal in the smectic C* phase would normally orient itself in a set of helices having a pitch of the order of 1 to 100 $\mu$m. By placing the material in a thin device, however, all of the helices are 'unwound' and the directors D of the molecules point in substantially the same direction as shown in FIG. 8(*a*).

The ferroelectric material is shown between the upper alignment layer 38 and the lower alignment layer 42 also shown in FIG. 7. As a consequence of the rubbing applied to the two alignment layers strong anchoring forces hold the molecules at the substrates of the device but at greater distances from the substrates, the effect diminishes. In the smectic C* phase with C2 alignment the material aligns itself in a plurality of chevron-shaped layers of which only one is shown at 50. FIG. 8(*a*) also shows a so-called end view of the layer for the sake of completeness. The actual configuration between the substrates of the device is complicated, depending on the alignment and the applied electric field. FIG. 8(*a*) shows an example of a material with little or no applied field. For simplicity of explanation in the following theoretical considerations we assume a uniform structure in which the director D is at an orientation $\phi$ throughout the sample.

FIG. 8(*b*) shows a graph of In-plane twist of the director against distance from the substrates at various applied voltages. The left hand curve and the right most dotted curve represent the two latched conditions. The graph can be better understood by consulting FIG. 8(*c*) which shows four stages in the change of state process. The molecules are numbered one to eight with number one being at the upper substrate. Molecules one and eight are constrained by their respective substrates and hence always occupy zero degrees on the graph. Molecules four and five are constrained by each other (in this C* case) and have only two stable states. It is these two states that give the device its bistable behaviour. Molecules 2, 3, 6 and 7 are rather less constrained. As can be seen from the second set of molecules in FIG. 8(*c*), these four molecules change state first (before numbers 4 and 5). Once an adequate voltage is applied these two molecules change state and latching has occurred.

Figure 9A:
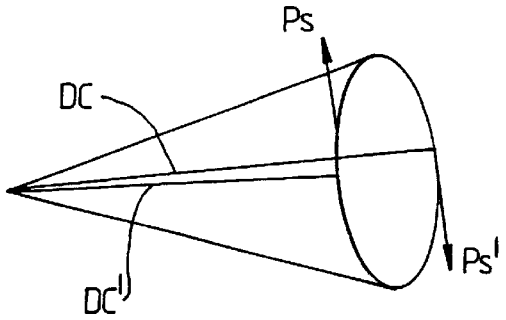
FIGS. 9*a* and 9*b* show a diagrammatic view of DC switched states and switching process for a ferroelectric liquid crystal.

FIG. 9*a* shows one of the switching cones around which the molecules (or directors) of the FLC material can be thought to move. The figure shows both of the possible fully-switched positions of the director DC and DC'. Ferroelectric liquid crystal devices switch as a result of a net DC field favouring one side of the cone. The polarisation directors of the molecules, $P_s$ and $P_s'$ respectively, are also shown. In practice, however, as will be discussed below, the director does not occupy these fully-switched positions.

Figure 9B:
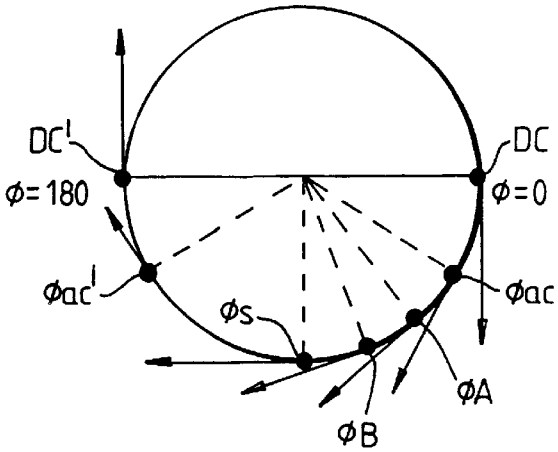

FIG. 9*b* shows a view of the cone from the end thereof (a so-called 'plan view') showing some positions of the director around the cone between position DC to position DC'. Position DC is denoted an angle of $\phi$=0° and position DC' is denoted an angle of $\phi$=180°. Looking at the figure, the director is assumed to rotate around the cone in a clockwise direction under the influence of an applied field of a certain polarity. However, the director of the liquid crystal molecules will only occupy the positions DC and DC' under the continued influence of an applied field of suitable polarity and sufficient magnitude. When such a field is not present the director relaxes around the cone away from the fully switched position to some extent. In this example the director starts from an angle marked $\phi_{ac}$ because this is the position that the director will occupy in use as a result of a constant AC signal applied across the pixel. The AC field is continuously applied as a consequence of addressing the device as an array of pixels and will be explained further below. $\phi_{ac}$ is a function of the distance of the director from the walls of the device but here we use a uniform director model to assist explanation. Ideally the angles $\phi_{ac}$ and $\phi_{ac}'$ will correspond to angles of ±22.5° in the plane of the device, in other words when the director is viewed normal to the device. When the component of the AC stabilised director orientation in the plane of the device is 22.5° this results in the two AC stabilised positions of the director being perceived as 45° apart which gives the best brightness in a device using crossed polarisers.

Another important point on the switching cone is that shown as 4 where the director is exactly half way between the two fully switched positions DC and DC'. Once the director has been switched to this point it will continue to move naturally towards DC' (although it will stop at $\phi_{ac}'$) to complete the switching process (at which point the liquid crystal is said to be latched). Switching occurs when the electric field results in a net torque on the directors tending to change $\phi$. The speed of the switching will depend on the magnitude of the torque and the total change in orientation through which the directors move. Ferroelectric liquid crystal devices switch as a result of a net DC field favouring one side of the cone (either right or left as shown in FIG. 9*b*). If the starting orientation is $\phi_{ac}$ and switching occurs when a net DC field of the correct polarity tends to cause reorientation towards $\phi_s$ (once the director has passed $\phi_s$ the pixel will have latched in the other state and the director will relax to the other side of the cone on removal of the DC field). Although prior art addressing techniques for ferroelectric liquid crystal displays as identified above have used strobe signal extensions at constant levels, the present invention is based on an appreciation that the performance of the ferroelectric device may be enhanced by tailoring the extension of the strobe signal considering the resultant signal in accordance with the position of the director as it moves. In particular the director position $\phi_s$ may not necessarily be attained during the first L.A.T. of the strobe signal.

The two factors that are most significant in determining the form of the strobe (and hence resultant) signal are the ferroelectric torque and the dielectric torque which are each related differently to the switching angle of the director and to the applied voltage. In addition the dielectric torque acts in opposition to the ferroelectric torque. This will be explained in greater detail with reference to FIGS. 10*a* and 10*b* below.

In the discussion which follows, the terms SELECT and NON_SELECT are used to denote signals intended to change the state of a pixel and not to change the state of the pixel respectively. This corresponds with the inverted operation described with reference to FIG. 2. The reverse will occur if the "normal" operation described with reference to FIG. 1 is employed.

Figure 10:
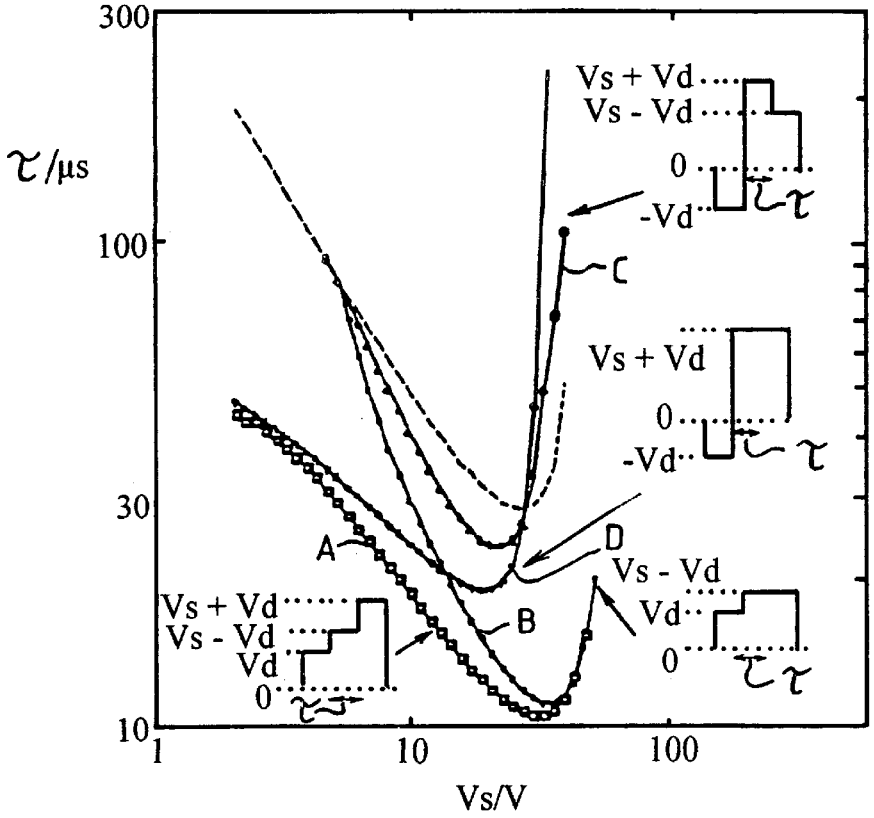
FIG. 10 PRIOR ART
FIG. 10 shows four graphs of latching time against applied voltage for a prior art addressing scheme.

FIG. 10 shows a graph of time against voltage for the MALVERN 2 strobe signal in conjunction with the possible combinations of DATA signal shown in FIG. 4. The curves A, B, C and D correspond with the resultant signals A, B, C and D in FIG. 4. Curve C is a NON-SELECT resultant signal in which the data signal in the following L.A.T. is the same as that for the data signal of the row under consideration. Curve D corresponds with a NON-SELECT resultant signal in which the data signal for the following L.A.T. is different from that of the row under consideration. Both curve C and curve D provide fairly large switching times and thus should give reasonable discrimination (since switching is not desired in the NON-SELECT case). Curve A corresponds with a SELECT resultant signal in which the data signal for the following L.A.T. is the same as for the row under consideration. This curve shows good performance with a wide range of operating voltages. Resultant curve B corresponds with a SELECT resultant signal in which the data signal for the following L.A.T. is different from that for the row under consideration. The resultant signal B lacks the portion at increased voltage towards the end exhibited by resultant signal A. Consequently, the operating range is reduced, the knee of curve B being sharper and requiring a longer duration of pulse to effect change of state than that for curve A.

Since the data signal in the following L.A.T. is not constrained, then the addressing signals have to be arranged to operate on the assumption that operating curve B applies. In some circumstances, therefore, the discrimination to be provided by MALVERN 2 places tight constraints on the driving circuitry.

Figure 11A:
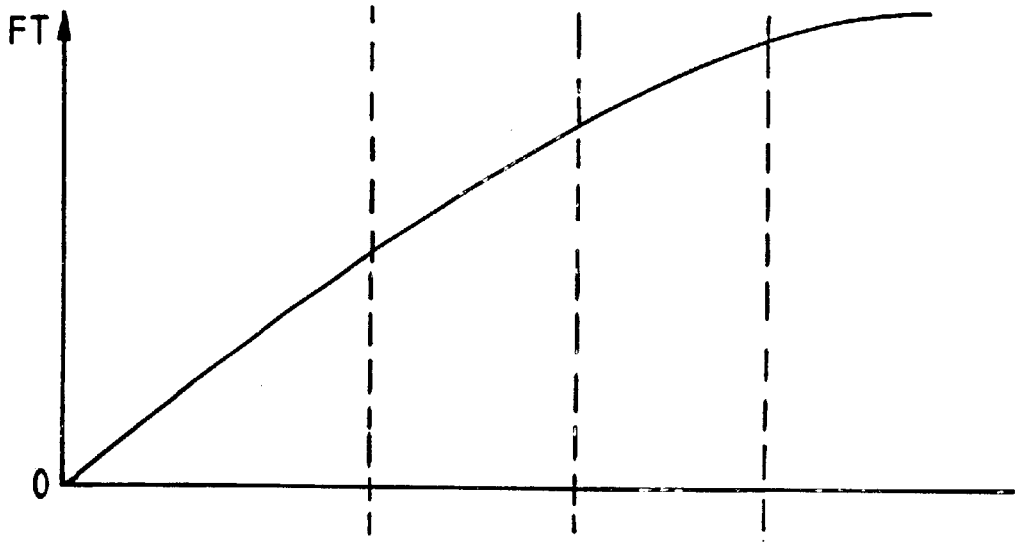
FIGS. 11*a* and 11*b* show a schematic graph of ferroelectric torque against director angle and a graph of dielectric torque against director angle.
Figure 11B:
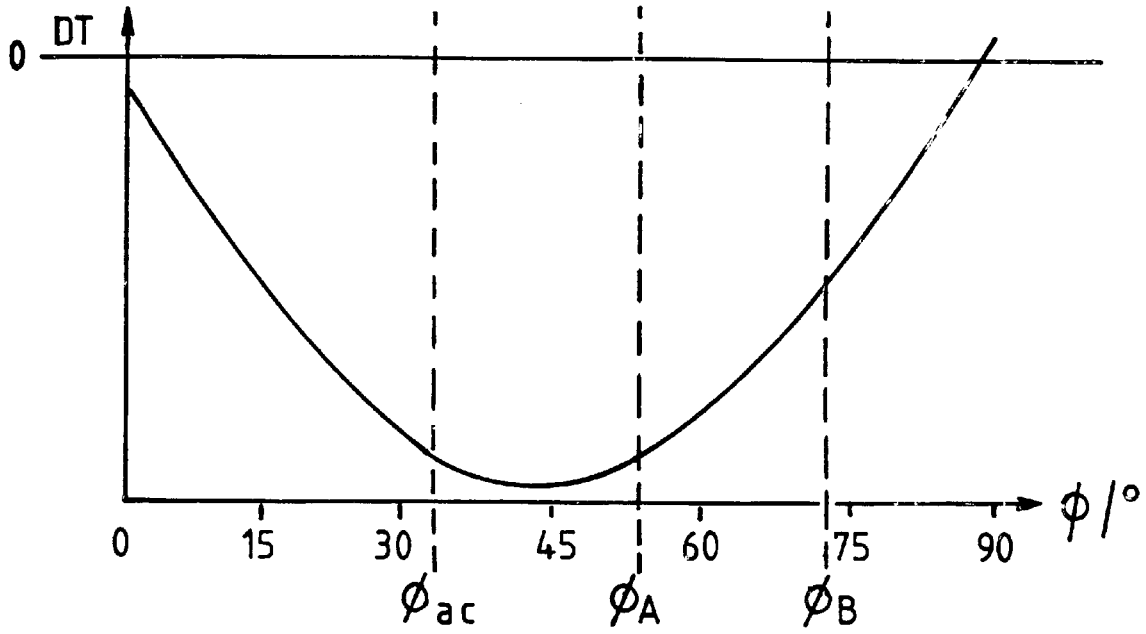

FIG. 11*a* shows the ferroelectric torque acting upon the director plotted against the director positions between DC and $\phi_s$ shown in FIG. 9*b*. The ferroelectric torque is dependent upon the position of the director around the cone as shown in the graph and is also linearly related to the magnitude and direction of the applied field for a particular director orientation. This torque acts on the director to make it rotate around the switching cone. The dielectric, or electrostatic, torque, shown in FIG. 11*b*, results from the ferroelectric material which aims to reduce the electrostatic free energy of the material, usually at a value of $\phi_{ac}$ close to 0° or 180°. The dielectric torque acts to oppose the ferroelectric torque, vanes with the position of the director as shown in the graph and is also proportional to the square of the voltage of the applied field. The effects of the two torques must both be considered to provide fast switching of the director when a SELECT signal is applied while not resulting in sufficient switching to alter the state of the director at other times. For typical ferroelectric materials, the dielectric torque terms ($\in_0$.E$\in$E) are smaller than the ferroelectric torque term ($P_s$E) except when the applied field is large. Thus, as the applied field is increased the switching speed increases until a maximum when the effect of the dielectric torque term reduces the speed of the device. FIGS. 11*a* and 11*b* are on different scales and are schematic graphs only to illustrate the dependence of the two torque terms upon director orientation.

The resultant torque $\Gamma$ applied to the director can be calculated mathematically. This has been shown in "the effect of the biaxial permittivity tensor and tilted layer geometry on the switching of ferroelectric liquid crystals" by M. J. Towler, J. C. Jones and E. P Raynes published in 1992 Liquid Crystals Vol.11 no. 3. An expression for the applied torque (ignoring elastic and inertial torques) is given by:

$$\Gamma = \eta\frac{d\phi}{dt} = P_s\frac{V}{d}\sin\phi - \varepsilon_0\frac{V^2}{d^2}\left[(\Delta\varepsilon\sin^2\theta - \partial\varepsilon)\cos^2\delta\sin\phi\cos\phi - \frac{\Delta\varepsilon}{4}\sin 2\theta\sin 2\delta\cos\phi\right]$$

In which the symbols represent the following, together with values used in the following examples:

| | | | |
|---|---|---|---|
| $\eta$ | is the switching viscosity of the liquid crystal | taken as | 100 cP |
| $P_s$ | is the ferroelectric spontaneous polarisation | taken as | +5 nCcm$^{-2}$ |
| $\phi$ | is the angle of director around the cone | | |
| V | is the applied voltage | | |
| d | is the spacing of the substrates of the device | taken as | 1.5 $\mu$m |
| $\epsilon_0$ | is the permittivity of free space | equal to | $8.854 \times 10^{-12}$ C$^2$/Nm$^2$ |
| $\theta$ | is the smectic C cone angle (i.e. the angle between the director and the layer normal) | taken as | 22.5° |
| $\partial$ | tilt angle of the layer normal from the substrate | taken as | 0.85$\theta$ |
| $\Delta\epsilon$ | is the uniaxial dielectric anisotropy | taken as | −1 |
| $\partial\epsilon$ | is the dielectric biaxiality | taken as | +0.4 |

Figure 12:
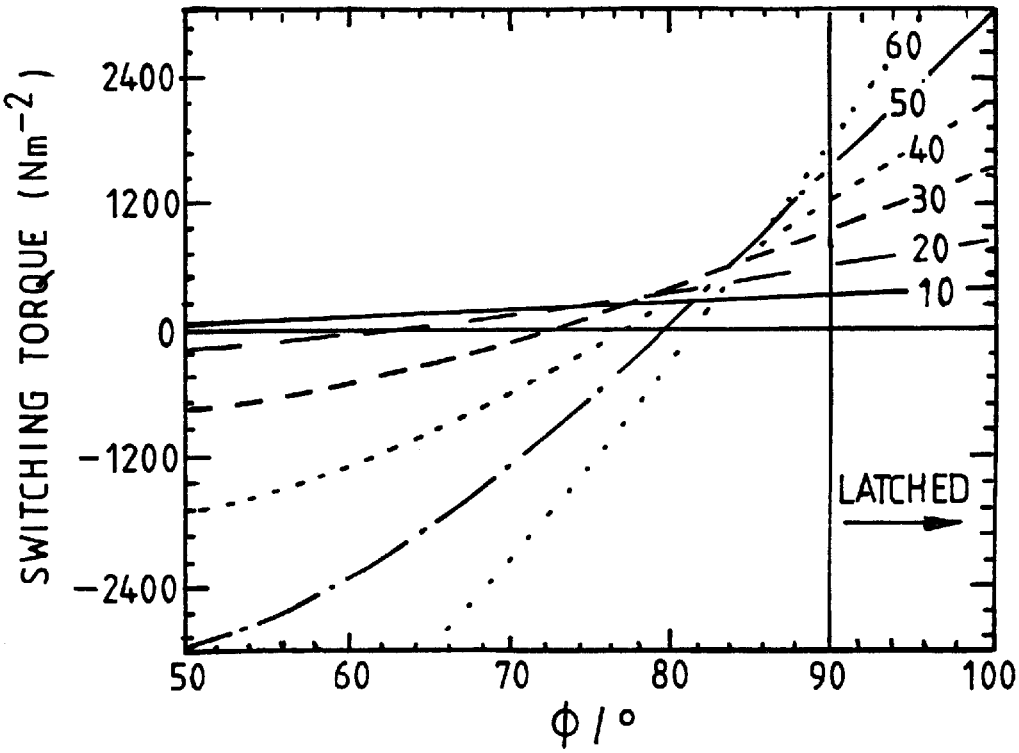
FIG. 12 shows a variation of switching torque with director angle and applied voltage for a typical ferroelectric liquid crystal.

FIG. 12 shows a series of curves (for different applied voltages) of resultant torque against director orientation for a device having the parameter values noted above. The curve corresponding to 10 volt is the shallowest of the curves but corresponds to a positive switching torque $\Gamma$ at all angles of the director between 50° and 90°. Positive values of $\Gamma$ cause the director angle $\phi$ to move towards 90° whereas negative values cause the director to move towards the AC field stabilised condition $\phi_{ac}$. The higher voltage curves, 20 volt to 60 volt, show that the application of a higher voltage results in a negative switching torque for small values of the switching angle $\phi$. This is the reason that there is a minimum value in the $\tau V$ curve for certain ferroelectric liquid crystal devices. Above a certain applied voltage, the dielectric torque starts to dominate the ferroelectric torque and the pixel will not switch.

In the present case, if it is imagined that the director is AC stabilised at an angle of approximately $\phi=60°$ then an applied voltage of 10 volt will apply a positive switching torque and the director will start to rotate towards $\phi 90°$. When the director reaches a point at approximately $\phi=72°$, it can be seen from the graph that a voltage of 20 volt will apply a greater positive switching torque so the driving voltage can be increased. When the director reaches a point at approximately $\phi=83°$ it can be seen from the graph that the applied voltage can be increased substantially, for example to the maximum value of 60 volt shown in the graph. Once the value of $\phi$ exceeds 90° the pixel is latched and the driving voltage may be removed. This is the significant part of the switching process for a liquid crystal array pixel since the switching voltage may now be removed.

The present invention stems from the realisation that, for a ferroelectric LCD, the switching performance of the device can be improved by varying the voltage level of the SELECT signal during the switching process and that switching process can overlap for adjacent rows. The NON_SELECT resultant signal is arranged to leave the pixel in the initial state by either:

(i) applying a voltage which is too small to move the director, (ii) applying a voltage which is negative and moves the director in the wrong direction, or (iii) applying a voltage which is so large that the dielectric terms equal or exceed the ferroelectric terms of the equation.

These techniques can be used in any combination. The first consideration is the speed of operation (or reduction of L.A.T.) and then the effect of a NON_SELECT resultant is considered to ensure that spurious switching into the other state will not occur.

In addition, for a given director orientation there is a switching voltage which gives maximum resultant torque $\Gamma$ so the discrete example given above can be extended to drive the pixel with a voltage waveform that is substantially constantly varying. The optimum applied voltage for maximum torque can be derived by differentiating the torque equation, setting the result to zero and checking that the second differential is negative. This gives an equation for V as follows:

$$V_{d\Gamma/dV=0} = \frac{P_s d \cdot \tan\phi}{2\varepsilon_0(\Delta\varepsilon\sin^2\theta - \partial\varepsilon)\cos^2\delta\sin\phi - \varepsilon_0\frac{\Delta\varepsilon}{2}\sin 2\theta\sin 2\delta}$$

Where the constituents are as before.

The torque equation can also be used to derive voltages for which there is no torque applied to the directors of the ferroelectric liquid crystal device. This is important to provide discrimination between pixels which are to be latched into the other state (i.e. SELECT) and pixels which are not to be latched into the other state (i.e. NON_SELECT) as will be described in detail below. Firstly, there is the trivial case where:

$$V=0$$

and when the ferroelectric and dielectric torques are balanced and in opposition:

$$V_{\Gamma=0} = \frac{P_s d \cdot \tan\phi}{\varepsilon_0(\Delta\varepsilon\sin^2\theta - \partial\varepsilon)\cos^2\delta\sin\phi - \varepsilon_0\frac{\Delta\varepsilon}{4}\sin 2\theta\sin 2\delta}$$

which gives a voltage of double that required to provide maximum torque.

Figure 13:
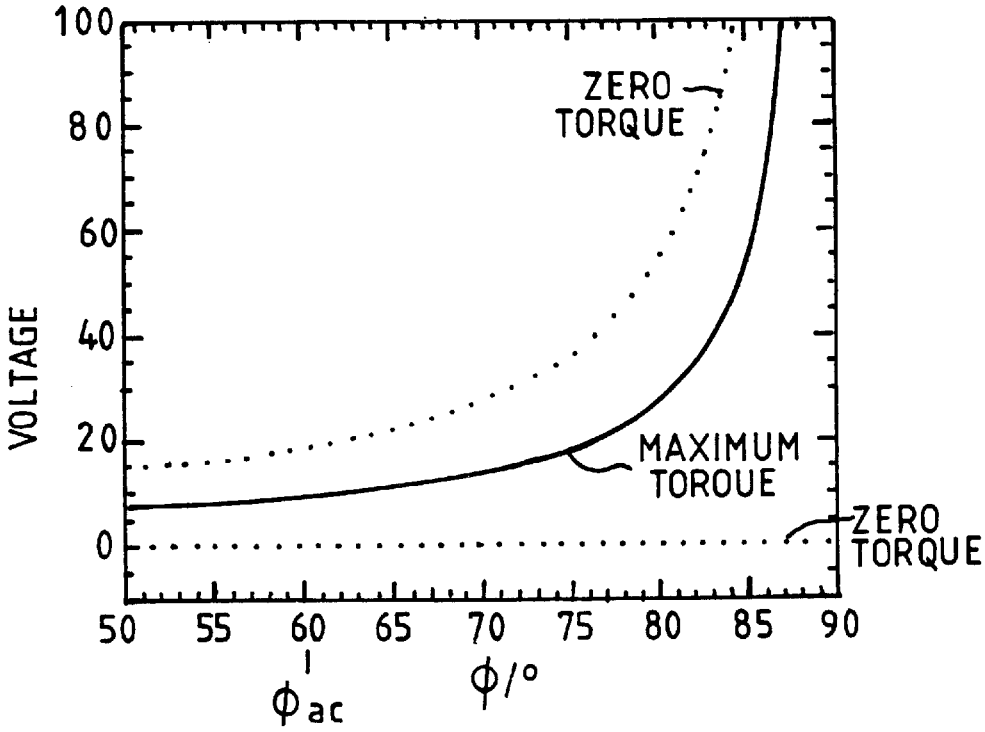
FIG. 13 shows graphs of voltage against director angle for both zero and maximum torque for a ferroelectric liquid crystal.

FIG. 13 shows three curves of voltage against director orientation for the case of maximum torque and the two cases of zero torque. The cases of zero torque are important to provide good discrimination between the SELECT and NON_SELECT signals to ensure that erroneous switching does not occur. A prior art multiplex addressing scheme will now be described in order to explain SELECT and NON-SELECT signals and discrimination between the two.

Figure 14:
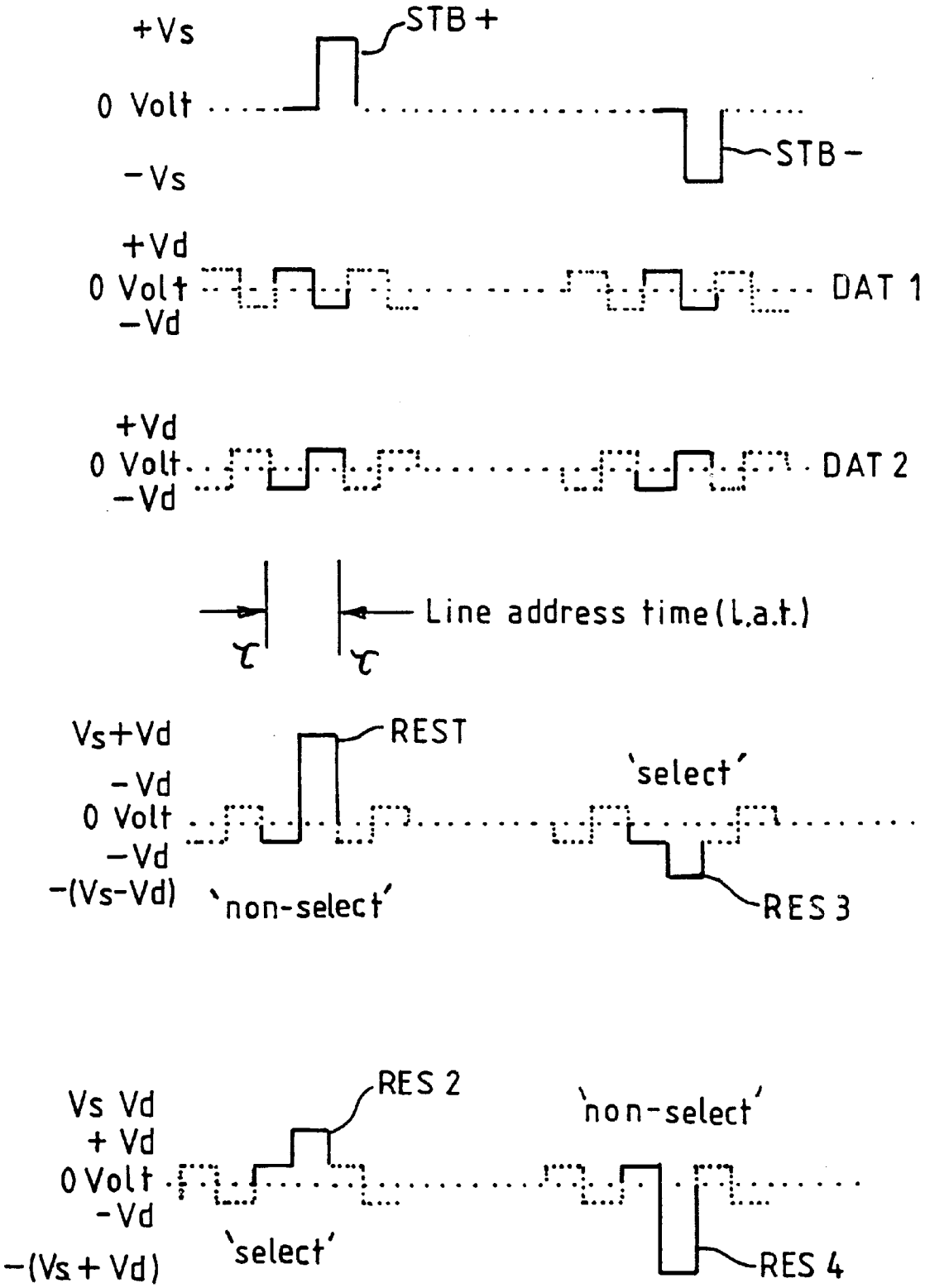
FIG. 14 PRIOR ART
FIG. 14 shows a number of prior art strobe and data signals.

FIG. 14 shows a prior art monopulse inverted addressing scheme for a ferroelectric liquid crystal array device in which a strobe signal is applied in succession to the row electrodes. The strobe signal comprises a positive going strobe signal STB+ and a negative going strobe signal STB−. The strobe signals each having a time slot of zero volt followed by an equal time slot of magnitude Vs volt. Either of the two data signals DAT1 and DAT2 having magnitudes of Vd may be applied to the column electrodes as required. While the strobe signal is applied to a particular row, a column driving arrangement must provide the appropriate data signal to every column electrode. One of these data signals, when combined with either STB+ or STB−, must cause the pixel to change state (SELECT) while the other data signal combined with the strobe signal must not cause the pixel to change state (NON_SELECT).

In FIG. 14 the combination of STB+ with DAT1 is shown at RES1 and this provides a NON_SELECT resultant signal. It is important to remember that the voltages of the strobe signal and the data signals must be subtracted to give the resultant signal since they are applied to either side of a pixel. The combination of STB+ with DAT2 results in the signal shown at RES2 and this provides a SELECT resultant signal. Thus by changing the data signal the pixel can either be left in the original state or latched into the state defined (in this example) by a positive-going pulse. The higher voltage signal thus provides NON_SELECT operation.

The JOERS/Alvey scheme described here (see earlier reference) is best applied to materials with $\tau V$ minima and works as follows. The strobe voltage includes a zero voltage portion in the first part of the time slot and when this is combined with the data signals it provides a pre-pulse of ±Vd followed by a time slot of voltage Vs±Vd. By operating the FLC device in a $\tau V$ minimum mode gives a SELECT resultant signal of (+Vd, Vs−Vd) and a NON_SELECT resultant signal of (−Vd, Vs+Vd). The pre-pulse Vd will either start to switch the director D from its initial state towards the DC stabilised state $\phi=0°$ or towards $\phi=90°$ depending on the polarity of the pre-pulse. During the second time slot when Vs is also applied, the director is no longer at its initial position $\phi_{ac}$ but is at position $\phi_A$ (FIG. 9(*b*)) for the select signal or at $\phi 0°$ for the non-select signal. This leads to improved discrimination between the switching and signals for altering the state and not altering the state and so latching of the device into the other state then occurs on the application of Vs−Vd but not on the application of Vs+Vd.

To switch a pixel to the other state a strobe pulse STB− of the other polarity is required and this will provide a SELECT resultant signal RES3 with the data signal waveform DAT1 and a NON_SELECT resultant waveform RES4 with the data waveform DAT2. However, this scheme requires that two periods of strobe signal are provided for every row of the device to be addressed. An alternative technique provides a blanking signal to every row in sequence at a time between 5 and 10 rows ahead of the strobe signal. The blanking signal has a large enough voltage-time product to latch all of the pixels in a row to one or other of the states regardless of whether the DAT1 or the DAT2 signal waveform is being applied to each pixel (as a consequence of addressing another row or rows of the device). Thus only one strobe signal needs to be applied to the rows of the device since those pixels required to be dark (for example) are already dark and only those which need to be switched to the light state need to have a SELECT resultant signal applied to them. Blanking signals are discussed in more detail with reference to FIG. 23 below.

For the fastest alteration of the state of the pixels it is required to provide a resultant signal which leads to maximum torque throughout the switching process for pixels to be latched into the opposite state and a resultant signal which leads to the lowest torque practical for pixels that are to remain unchanged. This can be provided by a combination of data signals and/or a strobe signal that is continuously varying. The strobe signal may be arranged to be a square wave signal and the data signals can be varying, the strobe signal may be arranged to be varying and the data signals may be square wave signals or both the data signals and the strobe signal may be continuously varying.

Figure 15:
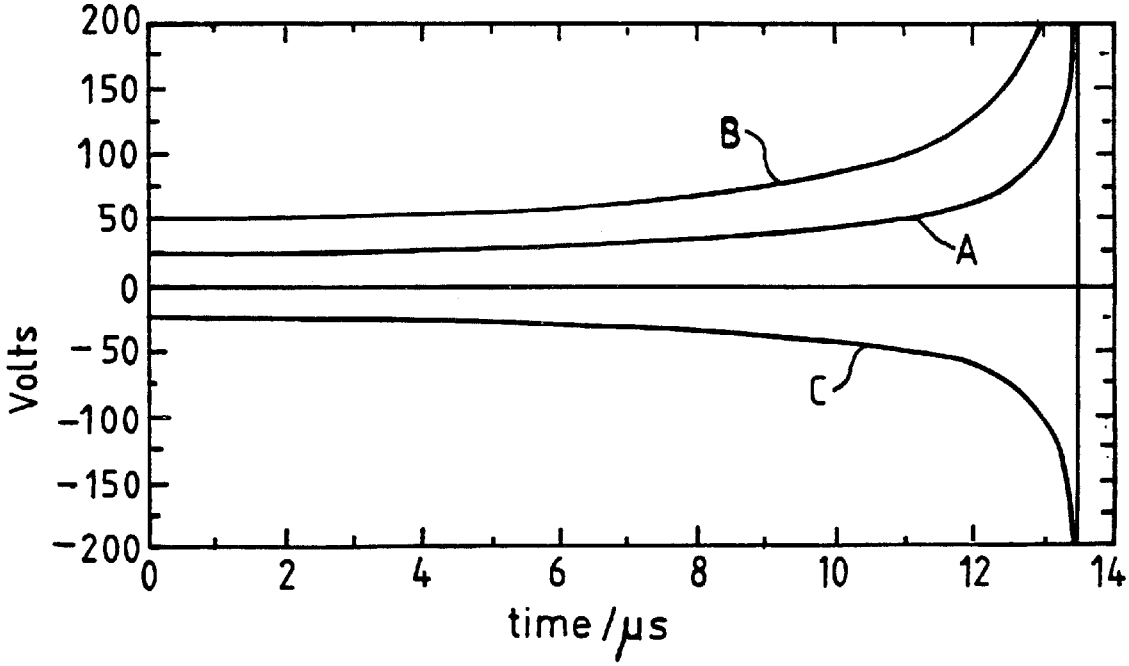
FIG. 15 shows graphs of applied voltage against time for zero switching torque, maximum switching torque and maximum negative switching torque for a ferroelectric liquid crystal.

By using the switching model described above, it is possible to use a numerical integration of the torque equation to derive ideal applied voltages as a function of time from the torque versus director orientation expressions. The version of the torque equation used does include an empirical elastic term as given by M. J. Towler and J. C. Jones in The Proceedings FLC, Tokyo 1993, page 164. This allows the optimum resultant signal to be computed although practical constraints, as will be seen, place some restrictions on the signals actually applied to devices in accordance with the invention. The results of one set of approximations (using the parameters previously described) is shown in FIG. 15. The curve A represents the resultant signal to be applied to a pixel for the fastest possible switching. As the director orientation $\phi$ approaches 90° there is a decreasingly small contribution to the torque expression from the electrostatic torque. Consequently, the optimum voltage to be applied is asymptotic to infinity and this voltage clearly cannot be provided in practice. However, the numerical integration results do show that the absolute shortest time for latching of the pixel is 13.4 $\mu$s for this particular material parameter set. By placing a restriction upon the maximum voltage that may be applied, practical applied voltage signals may be derived that provide latching times which only exceed this minimum value slightly. Curve B shows a non-switching resultant curve and curve C shows a voltage signal for generating maximum negative torque. The voltages of curves B and C will not cause the pixel to change state from that state which the applied field of curve A does cause switching.

The present invention exploits discrimination provided by the earlier part of SELECT and NON_SELECT resultant signals so that a second or extended part of a strobe signal can be provided to complete the latching of the pixel in response to a SELECT resultant. The directors of a pixel which has a NON_SELECT signal applied will be at a different angle to that of a pixel which has a SELECT signal applied at the end of the first part of the strobe signal. The second, non-specific part of the strobe signal then affects SELECT pixels to complete the latching while still not latching the NON_SELECT pixels, (indeed the higher voltage results in higher dielectric torque which actually slows switching). Therefore, the NON_SELECT resultant is slower and the operating region is enhanced. This can be understood by reference to FIG. 13. After the distinguishing portion of a SELECT resultant signal is applied to a pixel, the director angle might be 80°. After the distinguishing portion of a NON_SELECT resultant signal is applied (for example by using a negative pre-pulse), the director angle might be 70°. The second portion (extended portion) of the strobe signal is then arranged to substantially follow the MAXIMUM TORQUE curve. Because the director angle for the NON_SELECT pixels is different, the same applied strobe signal results in a torque much closer to the upper zero torque curve. Thus, the NON_SELECT pixels do not change state. Because a non-specific strobe signal may be applied in the second portion of the strobe signal in a multiplexed array, the next row or rows of the array may be addressed. Consequently, the L.A.T. may be reduced, the frame rate increased and operating window enlarged. In concept, the invention exploits a discrimination provided in the early part of the strobe signal together with the interaction of ferroelectric and dielectric torques.

A similar effect may also be possible whenever two torques are in opposition with different orders of voltage versus field effect (e.g. linear and square relationships).

Figure 16:
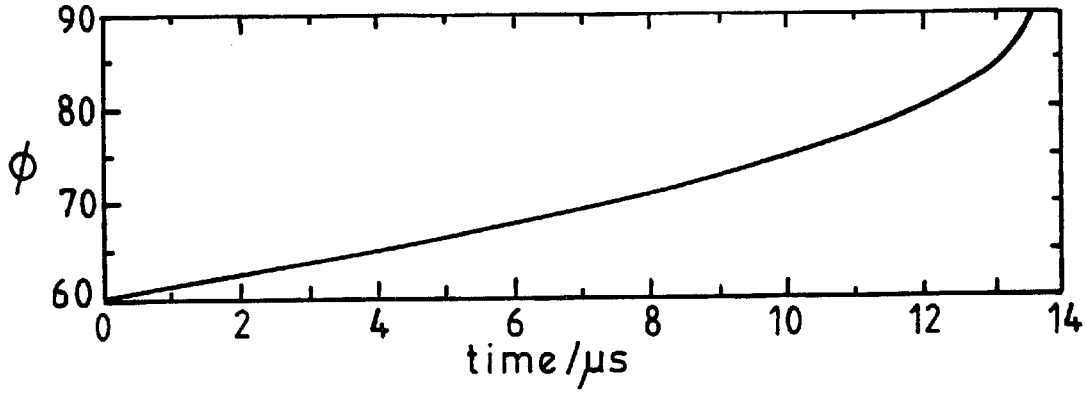
FIG. 16 shows a graph of theoretically predicted director orientation $\phi$ against time for the voltage shown in FIG. 11 to produce maximum torque.

FIG. 16 shows a graph of director orientation against time derived from the numerical integration calculation. By comparison with FIG. 15 it can be seen that, when the ideal voltage asymptotes to infinity, the director orientation is already very close to a value of 90°. Consequently, the restriction of the applied voltage will only reduce the operating speed very slightly from the theoretical maximum.

Figure 17:
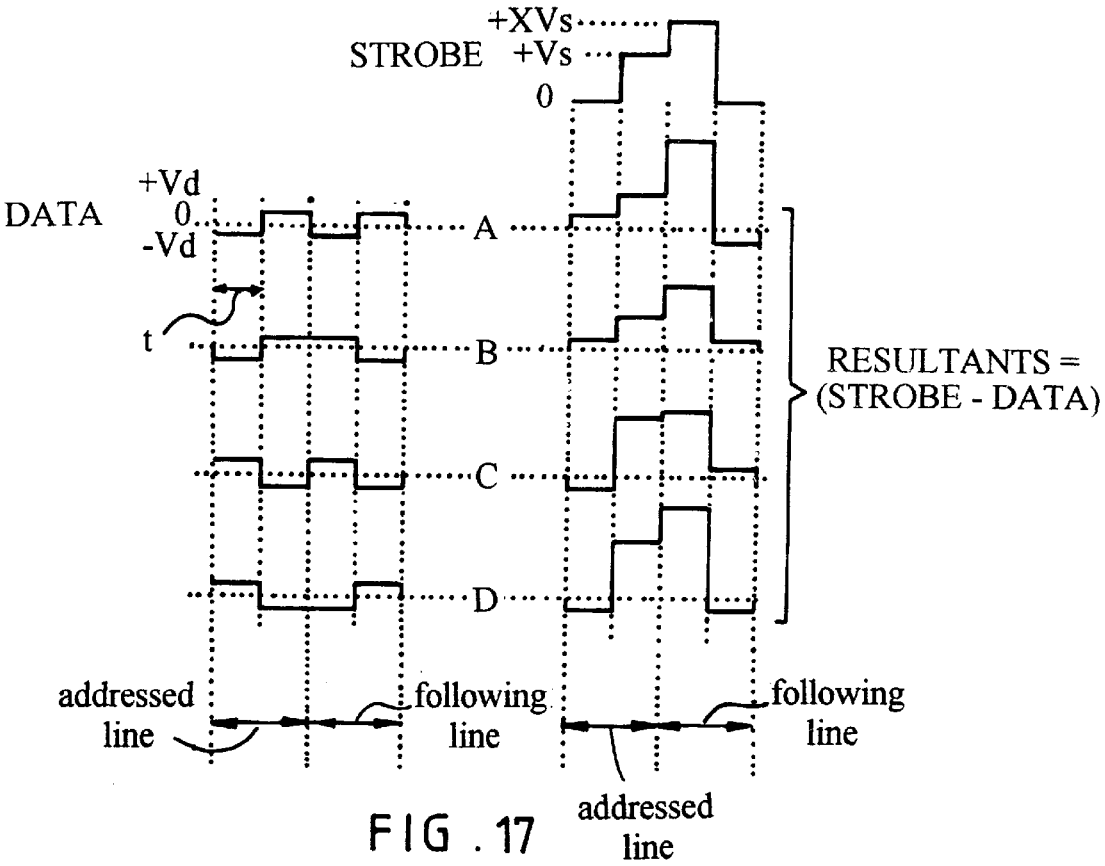
FIG. 17 shows data and strobe signals for applications to a liquid crystal array device in accordance with the invention.

FIG. 17 shows a strobe signal in accordance with the present invention. The signal is zero volt for time t followed by +Vs volt for time t followed by +XVs volt for time t. Since the L.A.T. of the device is equal to 2t, the strobe signal extends half of the way into the following L.A.T. in common with the MALVERN 2 addressing scheme described earlier. The four combinations of data signal A, B, C and D are shown in the left hand column and are as described previously with reference to FIG. 4. The resultant signals derived from the combination of these data signals in conjunction with the strobe signal in accordance with the invention are derived in the same manner as before and shown in the right hand column. It can be seen from this figure that resultant signal B, although at a lower voltage than resultant signal A during the third time period t is significantly closer in shape to the optimal signal shown in FIG. 14 than resultant signal B shown in FIG. 4 for the MALVERN 2 addressing scheme. The NON_SELECT resultant signals C and D maintain a sufficiently high voltage throughout to give no or only very slow switching. The negative-going part of these signals in the first time slot also assists the discrimination by moving the directors of a pixel in the wrong direction to change state.

Figure 18:
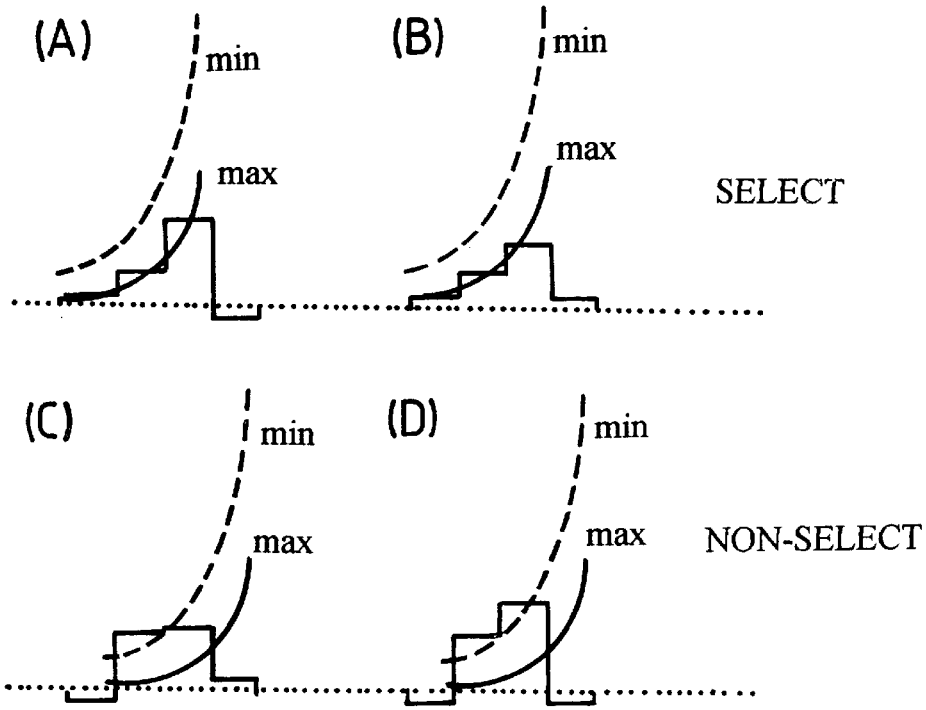
FIG. 18 shows SELECT and NON-SELECT resultant signals in accordance with the invention together with corresponding minimum and maximum torque curves.

FIG. 18 shows the resultant signals A, B, C and D shown in FIG. 17 with respect to the minimum torque and maximum torque curves shown in FIG. 13.

The increased voltage that is applied in the subsequent portion of the strobe signal does not increase the switching speed of the pixels which have NON-SELECT signals applied. This is beneficial because if this switching speed were increased it would lower the operating range.

Good discrimination is maintained because the voltage applied is closer to that given by the zero torque equation for the director in the position after the addressed line which received the NON-SELECT data signal. On the other hand, the SELECT data signal gave a resultant signal close to the condition for maximum torque given by the maximum torque equation. This is explained qualitatively by considering FIG. 13 as follows. Assume the curve of FIG. 13 is roughly linear so that the two slots of strobe signal in accordance with the invention in which the voltage is Vs or XVs (|X|>1) must cover roughly equal changes of orientation angle $\phi$. Imagine the AC stabilised condition has $\phi$=65°. The initial displacement of the director as a result of the SELECT resultant signal in the first time slot t (say +5V) moves the director to say 70°. In the following two time slots the director will more from 70° to 80° and from 80° to 90° respectively, after which the pixel will be latched (i.e. selected) into the opposite state. The voltage level Vs of the second time slot of the strobe signal is then chosen to be approximately 25V, so that the resultant select level of 20V is close to the optimum throughout the next portion of switching; i.e. approximately for $\phi$=75°. During the third time slot the data signal applied to the pixel is that for the following line and XVs is chosen to be 55V. Since the data signals are unconstrained the resultant signal will either be XVs+Vd (equal to 60V) or XVs−Vd (equal to 50V) and these provide approximately the same switching torques, both of which are close to the optimum.

The amount by which the strobe signal is increased during the third time slot (extended portion) determines the value of X. In the example above, the value of X is just over 2. While larger values of X will provide resultant signals closer to the optimum values shown in FIG. 18 there are practical constraints. Typically, the value of X will be constrained to be no more than 2. Even this value of X may result in voltages which cause damage to certain liquid crystal devices. A value of X which does not exceed 1.5 has been found to be a good compromise for some materials. However, with low $v_{min}$ materials, materials resistant to electrical damage or at very low temperatures (where all materials are sensitive to damage) a value of X=4 is possible.

If we now consider the NON_SELECT resultant signals (C and D in FIG. 17). The NON_SELECT resultant signal during the first time slot causes the displacement of the director back to 60°. The resultant signal applied in the second slot is Vs−Vd (equal to 30V), which is much higher than the level which gives zero torque. Hence, the director does not move from $\phi$=60°, and will not do so unless the voltage drops below that corresponding to zero torque (equal to 20V). In the third time slot of the prior art MALVERN 2 scheme (FIG. 4) the resultant voltage of pixel pattern C would be 20V which may cause some erroneous changes of state, thereby limiting the operating range, and decidedly preventing any further strobe extension. However, in accordance with the present invention, the strobe voltage is increased even further above the zero torque condition in the third time slot, thereby leading to good discrimination. This is provided even where the starting position of the directors varies due to alignment, temperature and voltage variations. If the strobe signal voltages are selected appropriately, this does not lead to the corresponding (unwanted) increase in the switching speed for the NON_SELECT resultant signals since the voltage is high enough for the dielectric terms of the resultant torque to still be significant due to the position of the directors.

Figure 19A:
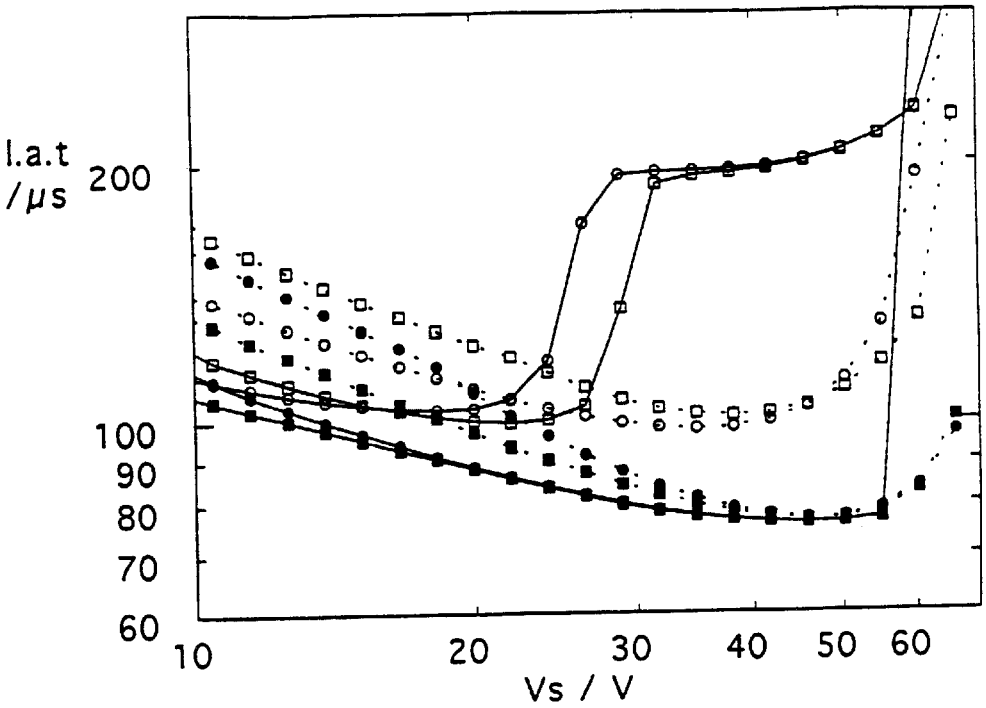
FIG. 19 shows theoretically predicted line address times against applied strobe signal voltage for the prior art and the present invention.
Figure 19B:
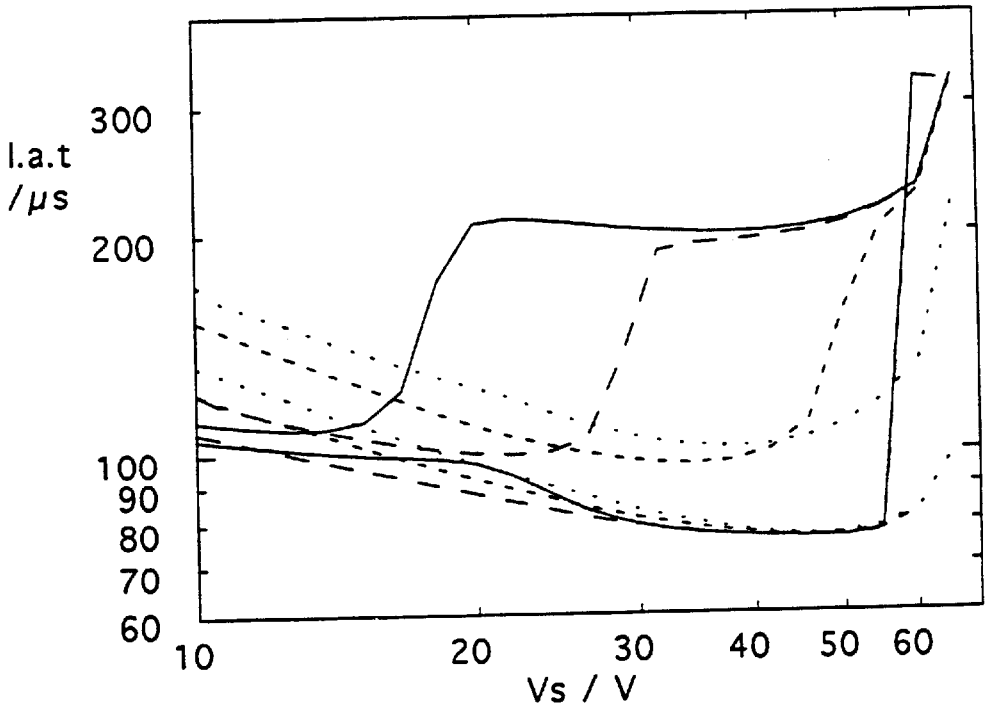

FIGS. 19A and 19B show curves of simulated line address time of both the present invention and the prior art MALVERN (FIG. 4) addressing techniques. FIG. 19A shows the large increase in discrimination for the present invention independent of pixel pattern and FIG. 19B shows the effect of altering the voltage level of the second (subsequent) portion of the strobe signal.

In FIG. 19A the curves corresponding with the prior art are shown in broken lines while those of the present embodiment of the invention are shown in solid lines. The prior art MALVERN 2 strobe signal is 0, +Vs, +Vs over the three time slots while that of the embodiment of the invention is 0, +Vs, +3Vs over the three time slots. The two possibilities for a SELECT data signal are −Vd, +Vd, −Vd illustrated by solid squares and −Vd, +Vd, +Vd illustrated by solid circles. The two possibilities for a NON_SELECT data signal are +Vd, −Vd, +Vd illustrated by open squares and +Vd, −Vd, −Vd illustrated by open circles. The SELECT resultant curves are all clustered towards the bottom of the graph illustrating fast latching at low voltage. However, the NON_SELECT resultant curves for the prior art addressing technique are only slightly higher than the select resultant curves illustrating poor discrimination. By contrast the NON_SELECT curves corresponding with the embodiment of the invention are well separated from the SELECT curves illustrating good discrimination. For example, at a strobe signal voltage of 40V, a line address time of 200 $\mu$s would be required to cause undesired latching. In the case of the prior art MALVERN 2 scheme this figure is barely 100 $\mu$s.

FIG. 19B shows the advantages of increasing the voltage applied during the extended period of the strobe signal. The dotted lines show the SELECT (lower) and NON_SELECT (upper) resultant signals corresponding to a strobe signal of 0, +Vs, +Vs, in other words the prior art MALVERN 2 scheme. The slightly longer dashed lines show the SELECT (lower) and NON_SELECT (upper) resultant signals corresponding to a strobe signal of 0, +Vs, +1.5Vs, showing improved discrimination. The longest broken lines show the SELECT (lower) and NON_SELECT (upper) resultant signals corresponding to a strobe signal of 0, +Vs, +3Vs, which corresponds to that shown in FIG. 19A. The solid lines show the SELECT (lower) and NON_SELECT (upper) resultant signals corresponding to a strobe signal of 0, +Vs, +4.5Vs, showing really good discrimination down to strobe voltages of 20V.

Figure 20:
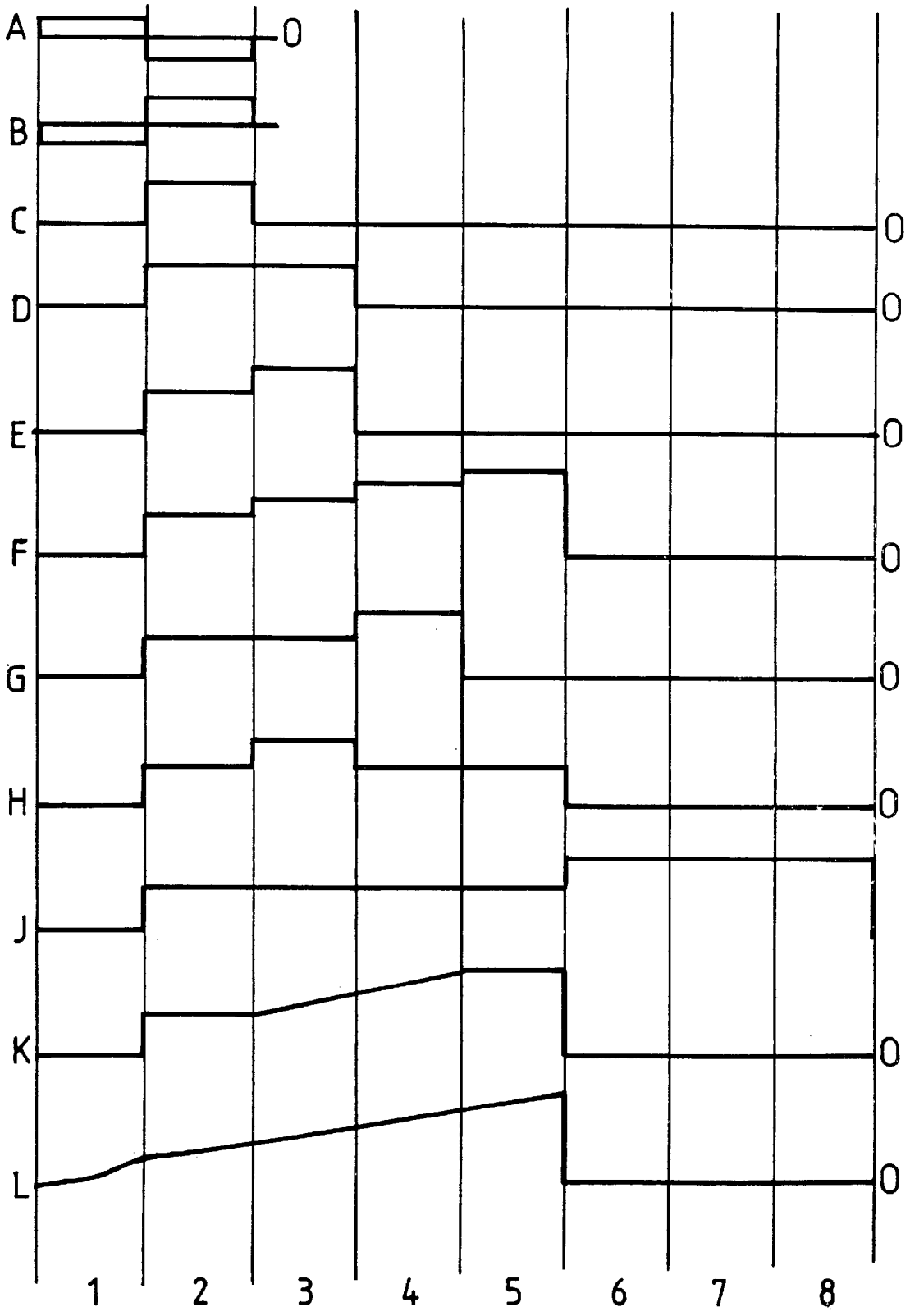
Figure 20:
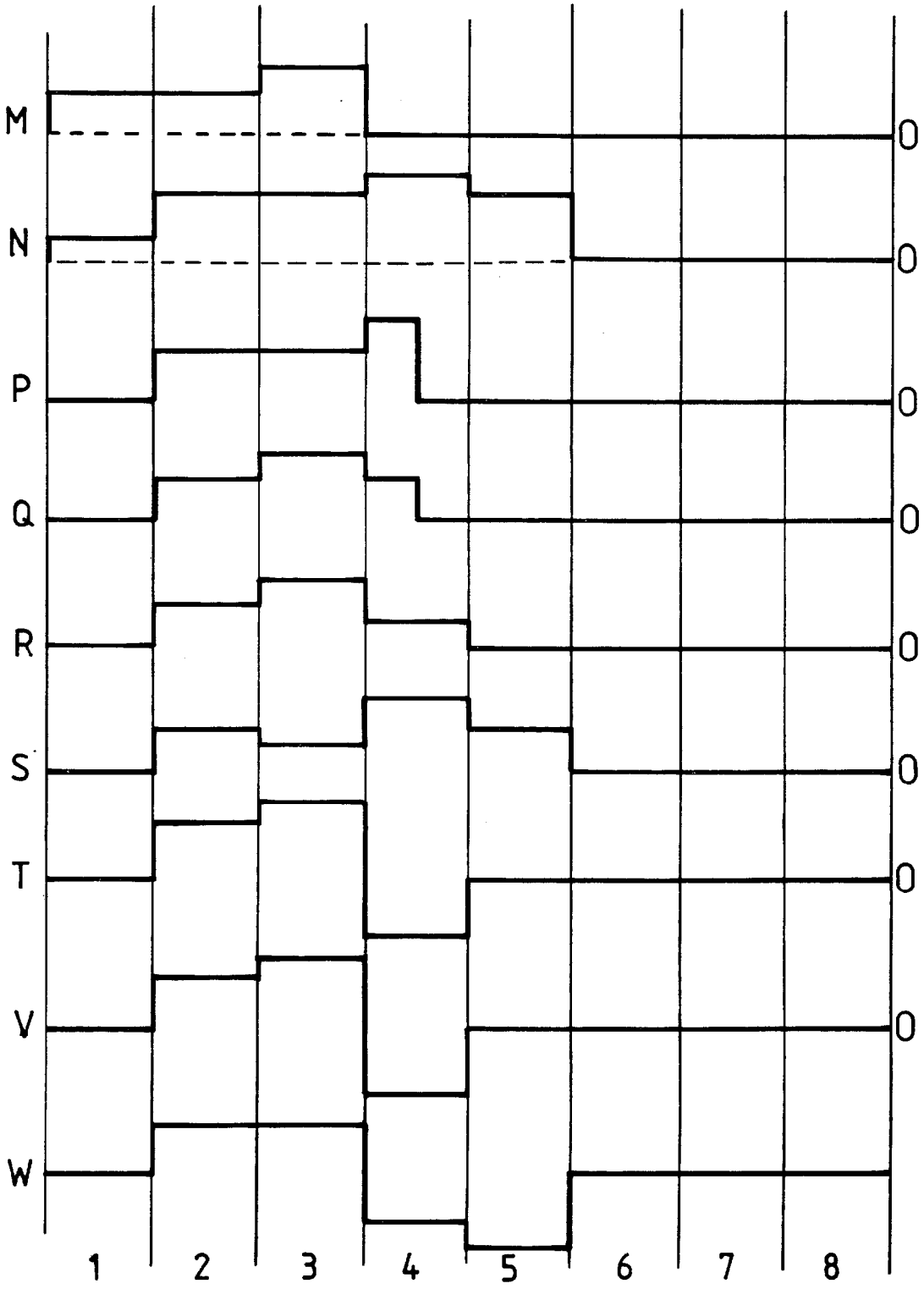

FIG. 20 shows some further examples of strobe and data signals of the prior art and in accordance with the present invention. From left to right in the figure eight numbered time slots are shown. A line address time (L.A.T.) corresponds with two time slots. FIG. 20(A) shows a NON_SELECT data signal while FIG. 20(B) shows a SELECT data signal. These are equivalent to the JOERS/Alvey data signals of the prior art. While the strobe signals of the present invention may be used with such data signals, use of other signals is possible. FIG. 20(C) shows the strobe signal of the prior art JOERS/Alvey addressing scheme for reference. FIG. 20(D) shows the prior art MALVERN 2 addressing scheme, also for reference.

FIGS. 20(E) to 20(W) show some exemplary strobe signals in accordance with the present invention.

FIG. 20(E) comprises zero volt in a first time slot, a voltage of $V_s$ in a second time slot and a voltage of $XV_s$ in a third time slot. The strobe signal then reverts to zero volt. This strobe signal corresponds to that shown in FIG. 18 and the value of X may be altered to provide fast operation combined with good discrimination. A value of X=2 is typical. The data signals shown at FIG. 20(A) and FIG. 20(B) relate to the addressed pixel only during the first and second time slots. The portion of the strobe signal shown at FIG. 20(E) in time slot 3 therefore comprises the second (or extended) portion of that signal. The signal may be further extended by providing a voltage of $XV_s$ or $2XV_s$ during the fourth time slot. In a matrix-addressed array device, the following row may be addressed from the start of the third time slot.

FIG. 20(F) shows a longer strobe signal than that shown in FIG. 20(E). The strobe signal is the same as that shown in FIG. 20(E) for the first three time slots. However, in time slot 4 the strobe voltage increases further to a value of $X_1V_s$ and in the fifth time slot it increases still further to a value of $X_2V_s$. The strobe voltage reverts to zero at the end of the fifth time slot. This is particularly suitable for use at low temperatures.

A MALVERN style extension of the strobe signal (without voltage increase) into, for example, a third addressing line would provide little or no discrimination—see FIGS. 5(*a*) and 5(*b*). The present invention is particularly useful for retaining some discrimination even when the strobe signal is extended well beyond the line that it is specifiacally intended to address such as that shown in FIG. 20(F).

FIG. 20(G) shows a strobe signal which is identical with the MALVERN 2 strobe signal for the first three time slots. In the fourth time slot the strobe voltage increases to $XV_s$ and then reverts to zero volt at the end of the fourth time slot. This signal illustrates that the increased voltage section of the strobe waveform need not occur as soon as the distinct portion of the data signals has ceased.

FIG. 20(H) shows a strobe signal which is equivalent to the strobe signal shown at FIG. 20(E) for the first three time slots. During the fourth and fifth time slots the strobe signal reduces to $V_s$. This strobe signal may be used to provide temperature compensation and optimisation of the optical contrast and brightness of a liquid crystal device, see below for a further discussion of temperature compensation.

FIG. 20(J) shows a strobe waveform in which in the first time slot is zero volt and time slots 2 to 5 has a voltage of $V_s$. Time slots 6, 7 and 8 then have a voltage of $XV_s$. This strobe waveform may be particularly applicable to a ferroelectric device addressed at very high speed in which the discriminating portion of a resultant signal (time slots 1 and 2 in this example) is a small proportion of the applied strobe signal. In common with the signal shown in FIG. 20(F) this is particularly suitable for use at low temperatures.

FIG. 20(K) illustrates a strobe signal which includes a substantially continuously varying voltage. In other words, it is not constrained to provide distinct discrete voltages in discrete time slots. Apparatus for providing such a signal will be described with reference to FIG. 24 below. In a first time slot, the strobe signal has zero volt, in a second time slot the voltage of $V_s$. During the third and fourth time slots the voltage increases steadily to a voltage of $XV_s$ and during the fifth time slot the voltage of $XV_s$ is maintained before the strobe signal reverts to zero volt at the end of the fifth time slot. Considering FIG. 18, it can be seen that the strobe signal shown in FIG. 20(K) can more closely approximate the minimum and maximum torque curves and provide improved switching performance and discrimination.

The substantially continuously varying voltage portion of the strobe signal may be applied during the first portion of the strobe signal as well (or instead of) the second, or extended, portion. FIG. 20(L) shows such a signal. During the first time slot the voltage starts at zero and increases approximately exponentially to a value of $xV_s$ (x is less than 1). During the second time slot the strobe voltage increases substantially linearly to a value of $V_s$. During the third, fourth and fifth time slots the strobe voltage increases substantially linearly to a value of $XV_s$. Again, by reference to FIG. 18 it can be seen that this strobe signal will more closely approximate the maximum torque and minimum torque curves to provide good change-of-state performance and discrimination.

FIG. 20(M) illustrates an alternative strobe signal which does not have a zero volt portion in the first time slot. During the first and second time slots the voltage is $V_s$. During a third time slot the voltage is $XV_s$ before reverting to zero volt at the end of the third time slot.

FIG. 20(N) shows a strobe signal in which a small strobe voltage is present during the first time slot and the remainder of the waveform may be similar to any of the others described, for example that shown in FIG. 19(F). The combination of the strobe signal and the NON_SELECT shown in FIG. 19(A) results in substantially zero volt resultant signal (and hence zero switching torque). The non-zero strobe voltage applied during this time slot may permit smaller values of data voltage (with consequent power dissipation benefits) to be used.

FIG. 20(P) shows a strobe signal modified to provide compensation for heating effects of the liquid crystal array. Temperature compensation may be provided by altering the duration of the strobe signal during time slot 4. In the figure, the strobe signal returns to zero volt approximately halfway through time slot 4. By advancing or retarding this return to zero volt, temperature compensation may be provided. Temperature compensation is discussed in greater detail with reference to FIG. 20(Q) below.

FIG. 20(Q) shows a strobe signal modified to provide compensation for heating effects of the liquid crystal array. Temperature measurement techniques are known for large area array devices to provide temperature variation details. Temperature compensation can then be readily achieved by providing the data corresponding to the further signals in the RAM and altering the addressing of the RAM to output the modified data signals as appropriate. Further details are available, inter alia, from:

International Patent Application Publication number WO95/24715, United Kingdom Patent Publication number GB2207272 and United States Patent U.S. Pat. No. 4,923,285.

The techniques taught in these prior art compensation techniques may be applied to strobe signals in accordance with the present invention. In FIG. 19(Q) the strobe signal is equivalent to that shown in FIG. 19(H) for the first three time slots. In the fourth time slot the strobe voltage reverts to a value of $V_s$ (although it could remain at the value of $XV_s$). The strobe signal shown in this figure reverts to zero volt at any time during the fourth time slot. As discussed previously, the operating curve of a ferroelectric liquid crystal device will move in use. This may be compensated by altering the strobe signal in some manner. In the strobe signal shown in FIGS. 19(P) and 19(Q) the duration of the second, or extended, portion of the strobe signal may be curtailed as the liquid crystal device becomes hotter in use. The signal may be lengthened when the array device is at a lower temperature.

FIG. 20(R) shows an alternative temperature compensated strobe signal. In contrast to that shown in FIG. 20(P) this strobe signal reverts to zero volt at the end of the fourth time slot. However, the voltage $xV_s$ during the fourth time slot is altered to provide the temperature compensation. In certain circumstances this may be preferred to altering the duration of the signal in the final time slot.

FIG. 20(S) shows a strobe signal having temperature compensation in which a reduced voltage section of the extended strobe signal is provided at time slot 3 before the high voltage section of the extended strobe signal is applied (in this case during time slot 4).

FIG. 20(T) shows a strobe signal having kickback, in other words a portion at a negative voltage. The strobe waveform is the same as that shown in FIG. 20(E) for the first three time slots followed by a fourth time slot at a voltage of $-V_s$. The kickback is provided to ensure that directors which have partially rotated in response to a NON-SELECT resultant signal return to the blanked state as rapidly as possible. The magnitude and duration of the kickback have to be selected to ensure that pixels which have latched in response to a SELECT resultant signal are not unlatched.

FIG. 20(V) shows a further example of a strobe waveform with kickback. This strobe signal is the same as that in FIG. 20(T) for the first three time slots but comprises a fourth time slot at a strobe voltage of $-XV_s$.

FIG. 20(W) shows a strobe signal which is the same as that shown in FIG. 20(D) for the first three time slots followed by a fourth time slot at a voltage of $-V_s$ and a fifth time slot at a voltage of $-XV_s$. This waveform therefore exploits the principles of the invention discussed above in the kickback portion of the strobe signal. In other words shaping of the kickback to give the fastest return to the blanked latched state using the techniques discussed above.

The purpose of the kickback signal is to prevent a reduction in contrast which can occur as follows. In the NON-SELECT case a transient can occur in the pixel whereby part of the pixel will actually change state. The purpose of the kickback signal is to force any such parts of pixels back to black. The kickback portion of the signal must be arranged so as not to undo the latching of those pixels to which a SELECT resultant signal has been applied.

Figure 21:
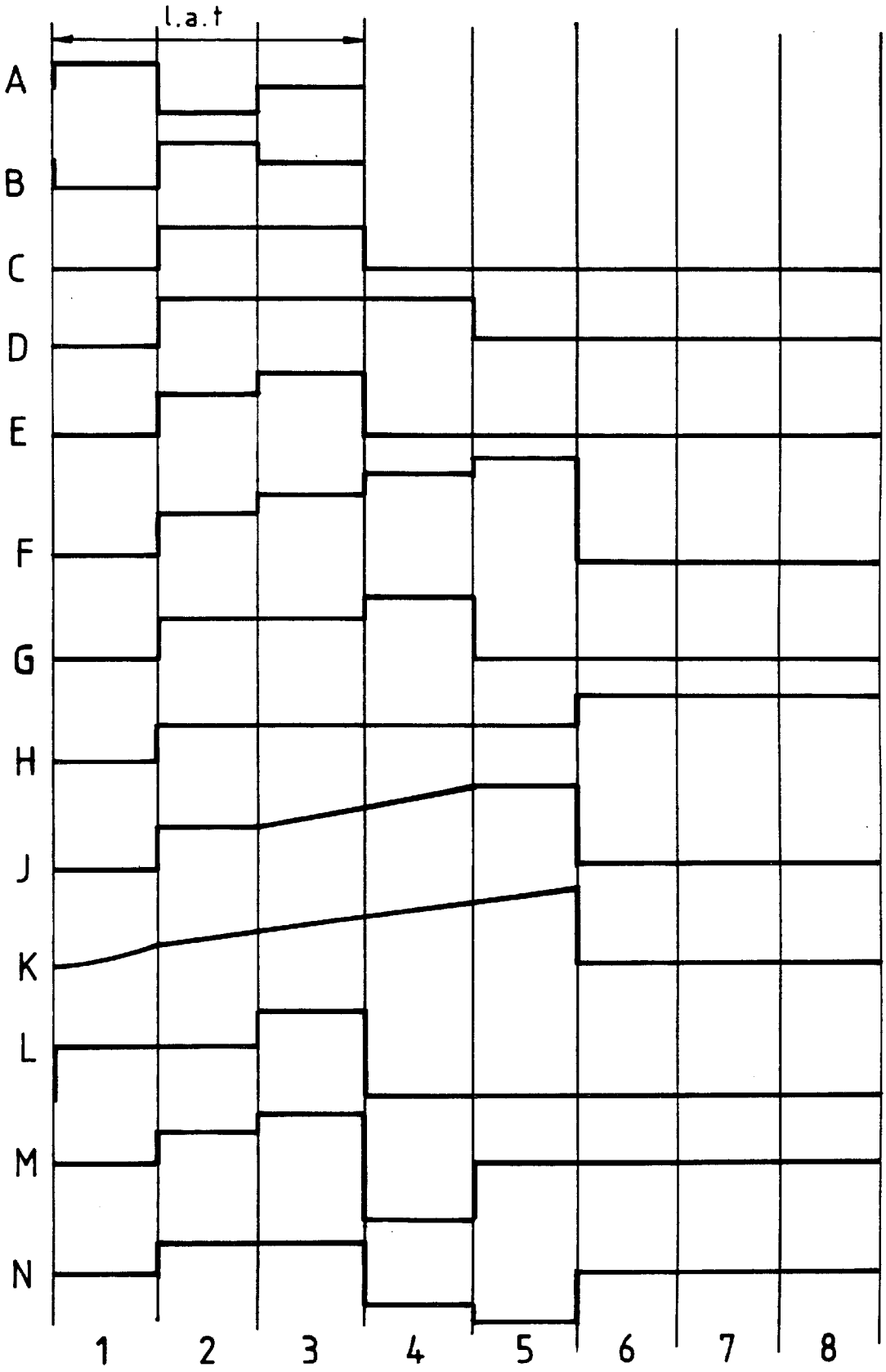
FIG. 21 shows further strobe signals in accordance with the invention for use in conjunction with prior art data signals FIGS. 21(A) and (B)

FIG. 21 shows some further examples of strobe signals in accordance with the present invention. In this case, the strobe signals are applied in conjunction with different data signals shown at FIGS. 21(A) and (B). FIG. 21(A) shows a NON-SELECT data signal which is identical to that data signal shown in FIG. 20(A) for time slots 1 and 2. Similarly, the SELECT data signal shown in FIG. 21(B) is identical to that of FIG. 20(B) in time slots 1 and 2. The data signals shown in FIGS. 21(A) and (B), however, further comprise a third time slot in which both the NON-SELECT and SELECT data signals return to zero volt. While the data signals are applied for three time slots the distinguishing duration of these two data signals is only two time slots, the same as that for the data signals shown in FIGS. 20(A) and (B). Since the two data signals in FIGS. 21(A) and (B) are the same in time slot 3 they can provide no discriminating effect during the third time slot.

FIG. 21(C) shows a prior art strobe signal which is zero volt in time slot 1 and $+V_s$ during time slots 2 and 3 before reverting to zero volt at the end of time slot 3. This strobe signal is thus applied only during the L.A.T. of the data signals.

FIG. 21(D) shows a prior art MALVERN strobe signal applied to these data signals. In contrast to the strobe signals shown in FIG. 21(C) this strobe signal remains at a voltage of $V_s$ for one further time slot (number 4).

FIGS. 21(E) to 21(N) show strobe signals in accordance with the present invention.

In FIG. 21(E) the signal is the same as that shown in FIG. 20(E), increasing to $+XV_s$ during the third time slot before reverting to zero volt. Although this strobe signal does not extend beyond one L.A.T. it comprises a strobe signal in accordance with the present invention because the increased voltage in time slot 3 is applied after the discriminating part of the data signals.

FIG. 21(F) shows a strobe signal which is the same as that shown in FIG. 20(F). The operation of this strobe signal in conjunction with the data waveforms of FIGS. 21(A) and (B) is analogous to that described with reference to FIG. 20(F).

FIG. 21(G) shows a strobe waveform which is the same as that shown in FIG. 20(G). In this case, the increased voltage portion of the strobe signal is applied in time slot 4 which will be during the following L.A.T. because the data signals are 3 time slots in length.

FIG. 21(H) shows a strobe signal the same as that shown in FIG. 20(J). Again, the portion of the strobe waveform having an increased voltage magnitude is not applied immediately after the discriminating part of the corresponding data signal.

FIG. 21(J) shows a strobe waveform the same as that shown in FIG. 20(K). The strobe voltage increases from $+V_s$ after the end of the discriminating part of the data signal (i.e. during time slot 3) but continues to rise during time slot 4 and maintains a higher value during time slot 5 before reverting to zero volt at the end of time slot 5.

This strobe waveform thus increases during the current L.A.T. and continues to increase during the following L.A.T.

FIG. 21(K) shows a strobe waveform the same as that shown in FIG. 20(L). This strobe signal includes the continuously varying portion during time slot 1 as well as during the remaining four time slots of the signal's duration.

FIG. 21(L) shows a strobe signal which is the same as that shown in FIG. 20(N). This strobe signal has a non-zero voltage during the first time slot. While the strobe signal does not extend beyond one L.A.T. the increased magnitude of the strobe signal voltage during time slot 3 occurs after the discriminating part of the data signal.

FIGS. 21(M) and (N) show strobe signals equivalent to those shown in FIGS. 20(V) and (W). These figures show strobe signals having a kickback portion. The effect of these strobe signals is as discussed above.

While some examples of strobe signals in accordance with the present invention which may be applied with 3 slot (1,1,0) data signals as shown in FIGS. 21(A) and (B) have been described, this is not to be taken in a limitative manner. Further strobe signals, for example those providing temperature compensation effects, may equally be applied in conjunction with (1,1,0) data signals.

Figure 22:
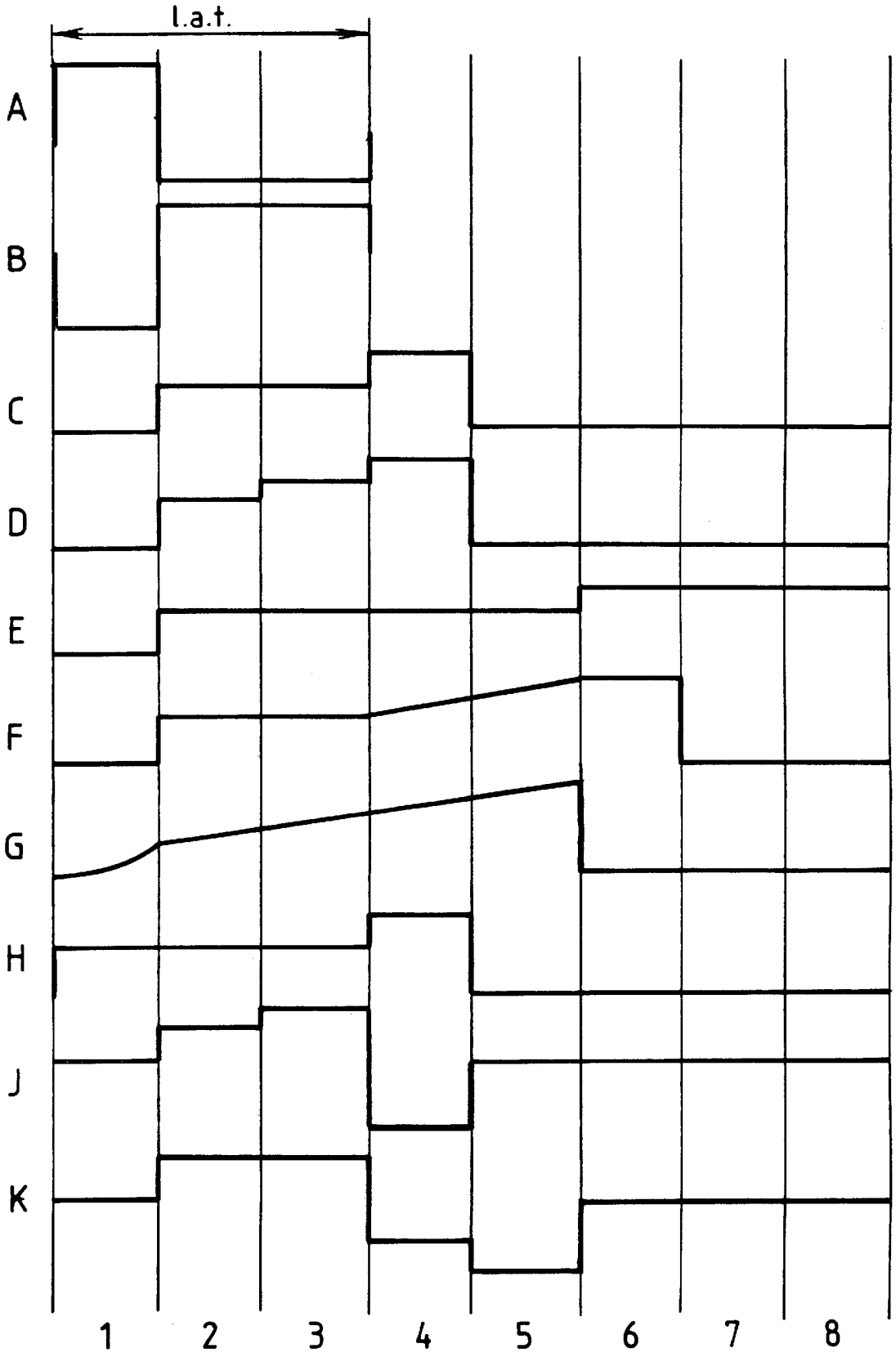
FIG. 22 shows further strobe signals in accordance with the invention for use in conjunction with the prior art data signals shown in FIGS. 22(A) and (B)

FIG. 22 shows some further examples of strobe signals in accordance with the present invention. In this case the strobe signals are applied in conjunction with so-called (2,1,1) data signals shown in FIGS. 22(A) and (B). The signal in FIG. 22(A) comprises a first time slot at a voltage $+2V_d$ followed by two time slots at a voltage of $-V_d$. The data signal shown in FIG. 22(B) has a first time slot at a voltage of $-V_d$ followed by two time slots at a voltage of $+V_d$. FIGS. 22(C) to (H) show a few exemplary strobe signals for use in conjunction with these data signals.

In FIG. 22(C) a strobe signal comprises an increased voltage portion during time slot 4 before reverting to zero volt.

In FIG. 22(D) the strobe signal increases between time slot 2 and time slot 3 (i.e. during the discriminating duration of the data signals) but further increases during time slot 4 which may be during the following L.A.T.

FIG. 22(E) shows a strobe signal the same as that shown in FIGS. 21(H) and 20(J) in which the increased voltage portion of the strobe signal commences some time after the end of the discriminating portion of the data signals.

FIG. 22(F) shows a strobe signal analogous to that shown in FIG. 20(K). In this case, because the discriminating portion of the data signals extends for three time slots, the increased voltage portion of the strobe signal commences at the end of time slot 3.

FIG. 22(G) shows a strobe signal the same as that shown in FIG. 21 (K) comprising a continuously varying voltage throughout five time slots.

FIG. 22(H) shows a strobe waveform which has a voltage of $+V_s$ throughout the three time slots corresponding to the discriminating part of the data signal. During time slot 4 the strobe voltage increases to $XV_s$ before reverting to zero volt at the end of time slot 4.

FIG. 22(J) shows a strobe signal which is zero volt during time slot 1, $+V_s$ during time slot 2, $+X_1V_s$ during time slot 3 and $-X_2V_s$ during time slot 4. The signal reverts to zero volt at the start of time slot 5 and $X_2$ is greater than $X_1$. The magnitude of the voltage of the strobe signal is thus increased after the discriminating portion of the data signals, although the increase occurs in a kickback during time slot 4.

FIG. 22(K) shows a strobe signal which is the same as that shown in FIG. 20(W). A kickback portion of the strobe signal during time slots 4 and 5 increases in magnitude before reverting to zero volt at the end of time slot 5.

While certain exemplary strobe signals in accordance with the present invention have been described for use in conjunction with (2,1,1) data signals, this is not to be construed in a limitative manner. Other strobe signals in accordance with the invention may be applied in conjunction with (2,1,1) data signals such as the temperature-compensating strobe signals of FIGS. 20(P) and (Q).

The strobe signals shown in FIGS. 20 to 22 may be used in a bi-polar addressing scheme (using two strobe signals of reversed polarity) or, more commonly, in a blanking signal addressing scheme. An example of an addressing scheme using a blanking signal is shown in FIG. 23. A blanking signal is typically applied to the row electrodes of a multiplex array five to ten rows ahead of the strobe signal. The liquid crystal device array may be blanked to either black or white but black (i.e. no or low light transmissivity) is more common. Because the blanking signal is applied at a time when any data signal might also be applied to respective pixels, it must be of sufficient voltage-time product to latch the pixels of that row reliably. Another consideration is that of DC balance with the following strobe signal. Undesirable ionic effects (among others) may occur if the signals applied to the row or data electrodes of a liquid crystal array device are not zero over the long term. Indeed, net DC will eventually cause the liquid crystal to change state regardless of the applied signal. It might even cause breakdown of the liquid crystal material. Thus, the blanking signal must be DC-balanced with the following strobe signal.

Figure 23A:
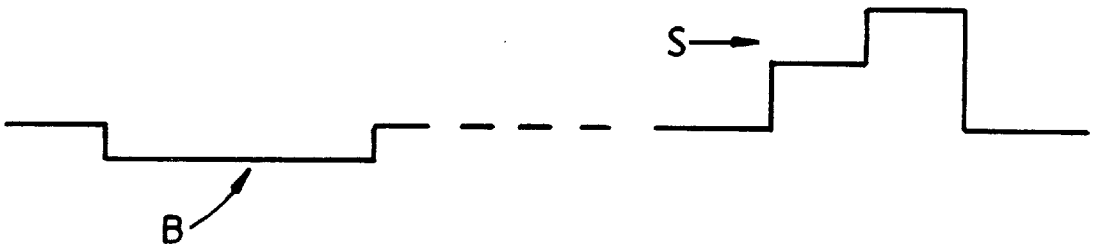
FIG. 23 shows a strobe signal and blanking signal combination in accordance with the invention.
Figure 23B:
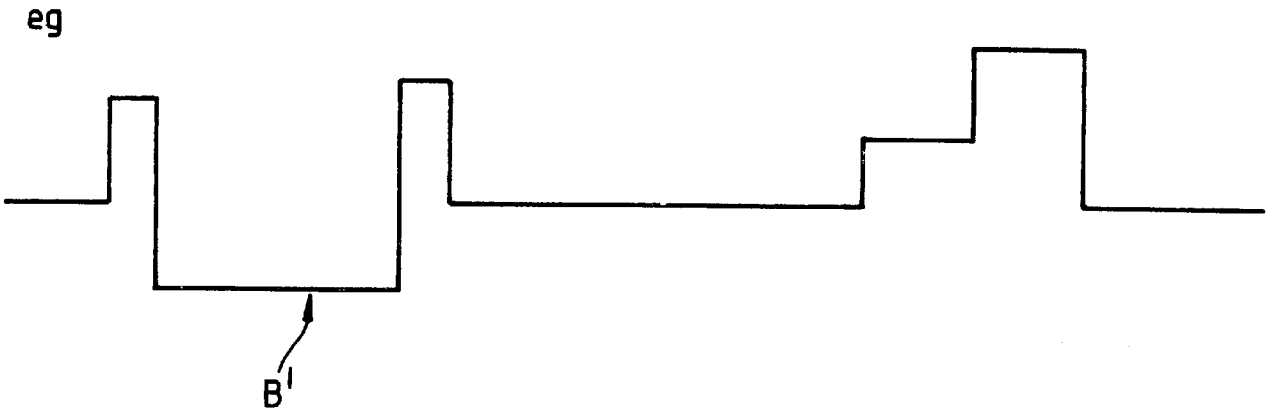

FIG. 23(A) shows a straightforward rectangular blanking signal B (not to scale) together with a strobe signal S in accordance with an embodiment of the invention. The horizontal axis represents time. FIG. 23(B) shows an alternative blanking signal B' together with the strobe signal S. Numerous other blanking signals are applicable in conjunction with the strobe signals according to the invention as will be apparent to the skilled person.

Figure 24:
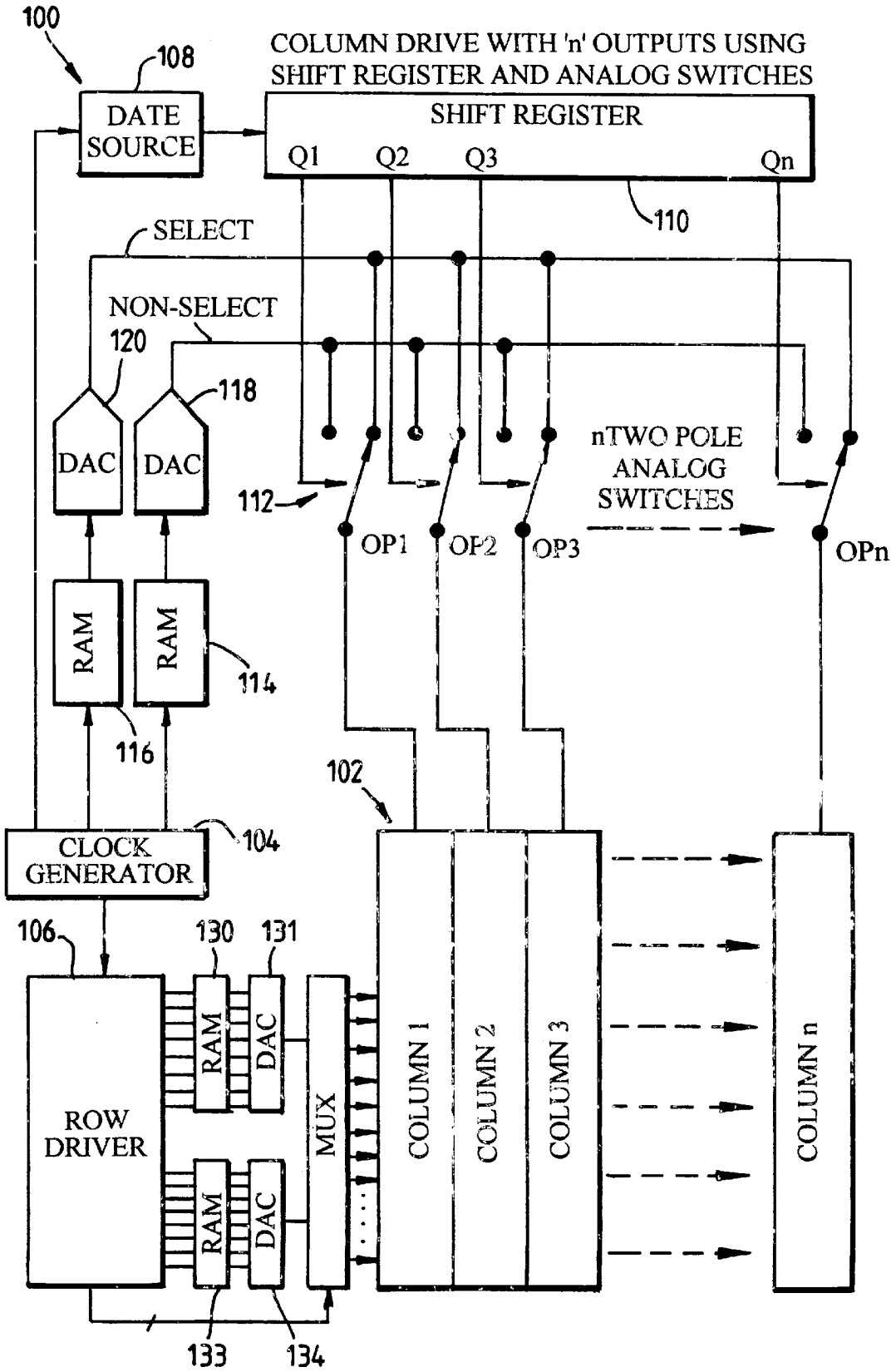
FIG. 24 shows addressing apparatus in accordance with the invention for applying varying strobe and blanking signals.

FIG. 24 shows a block schematic diagram of a possible driving arrangement 100 for providing continuously variable voltage signals in accordance with the present invention. A liquid crystal array 102 comprises a plurality of columns numbered 1 to n of which numbers 1, 2, 3 and n are shown. The driving of the array is controlled by a clock generator 104 which governs the timing of the signals applied to the array. The clock generator 104 is connected to a row driver 106 which is connected to all of the rows of the array via a random access memory (RAM) 130 and a digital to analogue converter (DAC) 131, a RAM 132, DAC 133 and a multiplexer (MUX) 134.

The row driver 106 provides a series of addressing waveforms to the RAMs 130 and 132. These provide data signals to the DACs 131 and 133 respectively. The DACs then generate signals in accordance with the values stored in the RAM, for example to provide signals as shown in FIG. 20(K) or FIG. 20(L). The multiplexer 134 then, under control of the row driver 106, provides these signals to the appropriate row electrode of the array.

Because, in accordance with an embodiment of the invention, two successive row electrodes are addressed simultaneously, a pair of RAMs and DACs are provided. These provide signals which overlap in time and are applied as appropriate by the multiplexer 134. Thus, a signal from RAM 130 and DAC 131 is provided to a row n of the array. Before this signal ceases, the RAM 131 and DAC 133 provide a signal (delayed in time with respect to the signal applied to row n) to row n+1. While this signal is being applied to row n+1 the signal applied to row n ceases and the RAM 130 and DAC 131 are controlled by the row driver 106 to start applying the same strobe signal to row n+2. The process continues with the pairing of RAM 130 and DAC 131 leapfrogging the RAM 132 and DAC 133 and vice versa.

Where more than two rows of the array are to be addressed simultaneously, the appropriate number of RAM and DAC combinations arc required. For example three for three simultaneous rows and so on. The embodiment shown in FIG. 22 assumes that a standard, rectangular blanking pulse is applied by the multiplexer 134 under control of the row driver 106. It is also possible to apply a continuously-varying blanking signal in a manner akin to that described for the strobe signals at FIGS. 20(K) and 20(L). In this case, further RAM and DAC combinations will be required to provide the relevant blanking signals ahead of the strobe signals.

In the arrangement shown in FIG. 24, it is also assumed that a continuously varying data signal is to be provided. However, this need not be the case in practice and straightforward SELECT and NON_SELECT data signals such as shown in FIGS. 20(A) and 20(B) may be used. In this case, the RAM and DAC combinations for providing SELECT and NON_SELECT signals to the column electrodes of the array may be omitted.

The clock generator is also connected to a data source 108 which provides the data relating to the desired state of each pixel in a particular row for each application of the strobe signal. A signal from the clock generator 104 clocks this data into a shift register 110 every time that a new row is addressed. The shift register has n outputs Q1 to Qn, in other words one for each column of the display, and each of these outputs controls one of n analogue switches 112. Under the control of the outputs of the shift register 110, the analogue switches couple either a SELECT or a NON_SELECT data signal to their respective columns of the array. The SELECT data signal is provided by a digital to analogue converter (DAC) 120 which is provided with digital data from a random access memory (RAM) 116. The NON_SELECT data signal is provided by a DAC 118 provided with digital data from a RAM 114. The RAM 116 and the RAM 118 contain digitised versions of the SELECT data and NON_SELECT data signals shown, for example, in FIG. 12. The RAMs are addressed by the clock generator 104 providing a parallel signal which counts up at a fast rate to clock the digital signals representing the data signals out of the RAMs. The DACs convert these signals into a pair of substantially continuously varying signals which are applied to respective poles of the switches 112. The relevant data signal is selected from the outputs of the DACs by the plurality of switches 112 and the required combination of strobe signal and data signal waveform can be applied to each pixel in the array. The RAMs must be clocked at a sufficiently high rate and the RAM/DAC combination must be of high enough resolution to mimic the desired signal waveform accurately.

The row driver may be arranged to provide a bidirectional strobe signal of the type shown in FIG. 14 or a blanking signal ahead of the application of the strobe signal. The blanking signal is chosen to latch the pixels in a particular row into a given state regardless of the data waveform applied to the pixel at that instant. The blanking pulse is typically applied 5 to 10 rows ahead of the strobe signal. If the blanking pulse is applied too far ahead of the strobe pulse then a disturbance in the display is noticeable to a user while if it is applied too soon before the strobe signal then the directors of the pixels to be switched may well be close to $\phi=0°$ rather than $\phi_{ac}$ and this will cause the operation speed to deteriorate. The blanking pulse may be arranged to comprise a signal having at least a portion of which is a continuously varying signal.

Where the SELECT and the NON_SELECT substantially continuously varying data signals are inverted versions of each other then the RAM 114 and the DAC 118 can be omitted. In this case the NON_SELECT waveform may be derived from the SELECT waveform by using an inverting buffer connected to the output of the DAC 120. Where the data source 108 can provide the required data in a parallel format, the shift register may be omitted and the data source connected to control the analogue switches 112 directly. The clock generator 104 may also be provided with means to alter the data signals in response to operational data from the liquid crystal device array. For example, it may be desired to change the amplitude and/or the shape of the data signals as the array becomes hotter in use.

Figure 25:
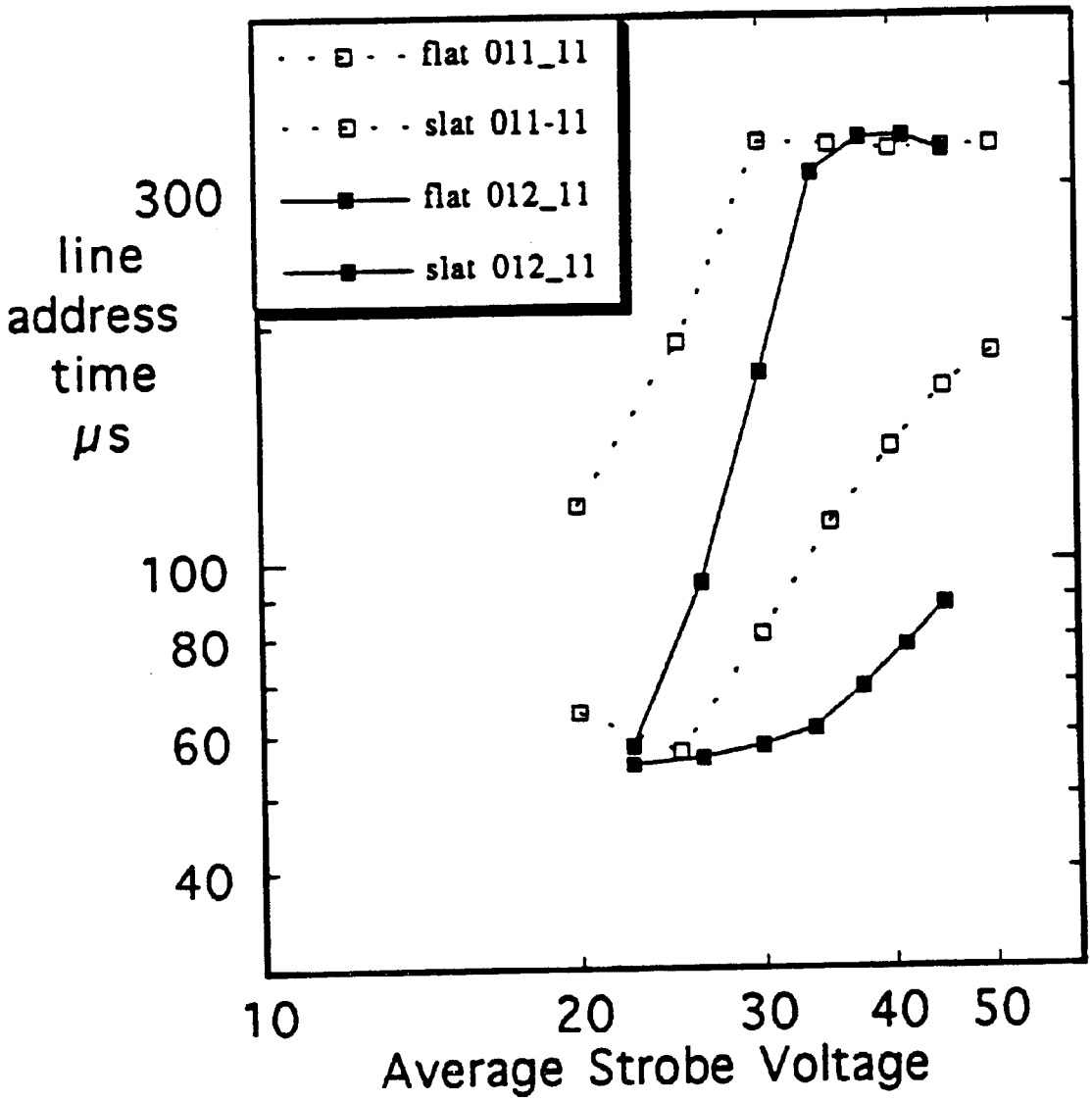
FIG. 25 shows a graph of experimental results which compares the present invention with a prior art addressing technique.

FIG. 25 shows a set of experimental results for the present invention for a 1.5 $\mu$m cell filled with the commercial liquid crystal SCE8. The filled squares in the graph represent results obtained by using a strobe signal in accordance with the invention, in this case one in which the further period was at a voltage of double that used in the first period. The open squares represent results obtained from the prior art MALVERN 2 addressing scheme. The horizontal axis shows average strobe voltage in order to make a fairer comparison between the two schemes.

The operating region for the prior art scheme is bounded by the two curves shown with open squares while that for the embodiment of the present invention is bounded by the curves shown with filled squares. The vertical axis shows the minimum line address time in each case. All of the results were derived using the worst case pixel pattern. That is the pixel pattern in the following addressing lines that causes the most problems to the desired change of state. Thus, for the slowest switching results (upper two curves) the pixel pattern that resulted in the fastest switching was used. For the fastest switching results (lower two curves) the pixel pattern that resulted in the slowest switching was used. The curves therefore represent the limiting case for correct operation.

At first glance the present invention may appear to provide only a modest improvement over the MALVERN 2 addressing scheme. However, it is important to look at the part of the graph relating to the very shortest line address times. A line address time of 60 $\mu$s is extremely good for the SCE8 material under consideration and the operating region at this L.A.T. is significantly larger in the case of the strobe signal in accordance with the present invention.

Figure 26:
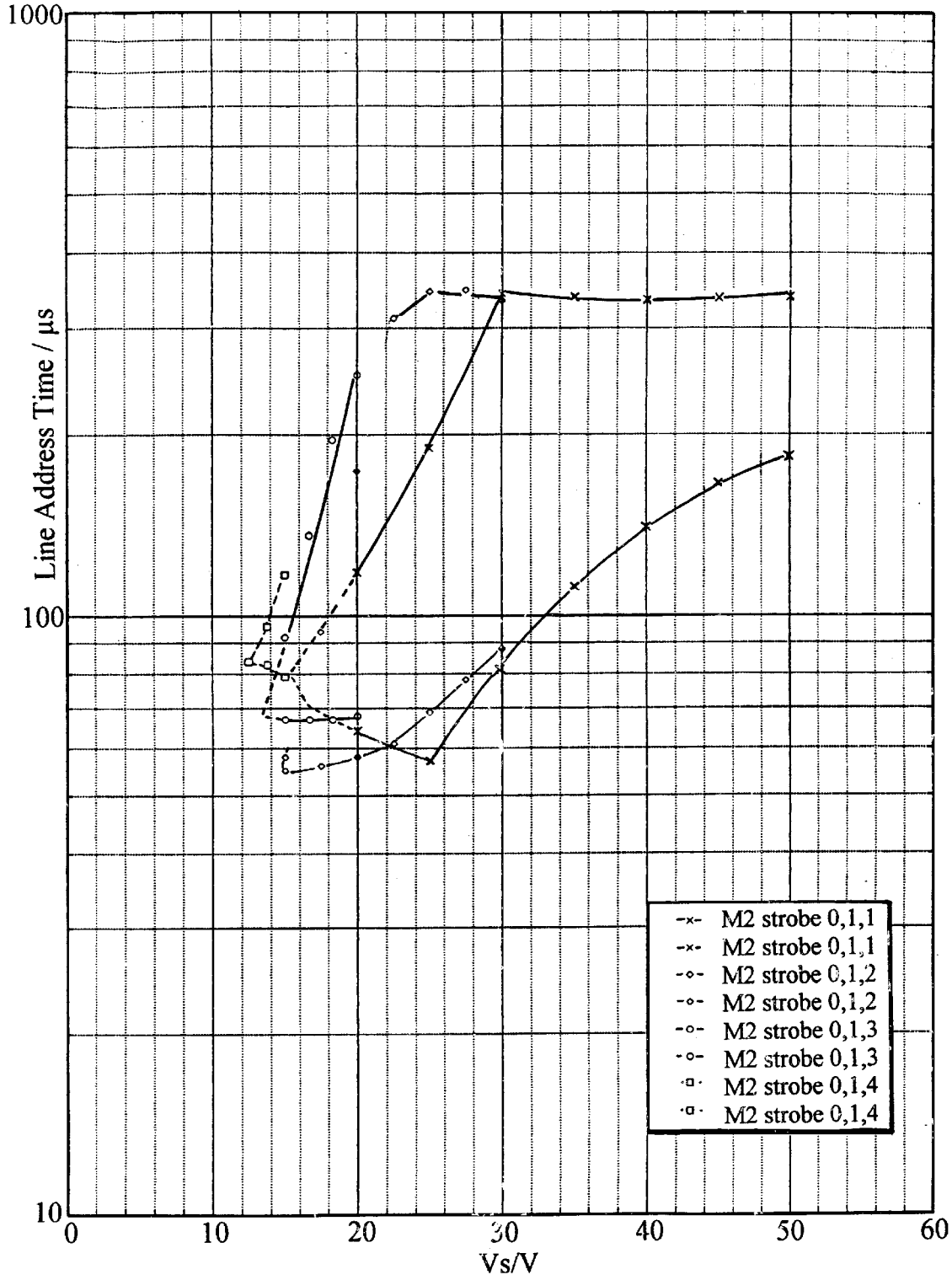
FIG. 26 shows a further graph of experimental results which compares the present invention with a prior art addressing technique using the same device as the results shown in FIG. 25.

FIG. 26 shows another graph of experimental results for the liquid crystal device whose results are shown in FIG. 25. The graph shows an operating region for the prior art MALVERN addressing scheme and operating regions for three different addressing schemes in accordance with the present invention. In all cases the duration of the extension of the strobe signal is the same.

The prior art scheme is a simple extension of the strobe signal without increase in the voltage beyond the line being addressed. The operating region is shown by two curves marked with multiply signs. (M2 strobe 0,1,1).

The three schemes in accordance with the invention correspond with strobe signal voltage increases of two, three and four times after the line being addressed. The operating region at twice the voltage is between two curves shown with open diamonds (M2 strobe 0,1,2). The operating region at three times the voltage is between two curves shown with open circles (M2 strobe 1,1,3). The operating region at four times the voltage is between two curves shown with open squares (M2 strobe 0,1,4).

In this example the extended strobe signal at twice the strobe voltage gives an improvement over the prior art in both speed and applied voltage. The other two schemes only give an advantage in terms of applied voltage. However, it is important to reaslise that for other materials, devices and so on the extended strobe signals at three and four times the voltage will provide the best improvements.

Advantages of the present invention include:

1. Faster line address times. The select resultant signal will automatically be arranged to follow the optimum torque curve as closely as possible for each pixel pattern.
2. Improved operating ranges. This is very important since it allows insensitivity to alignment, temperature and voltage variations. It also allows extension of the strobe signal by further numbers of L.A.T. (even if the additional slots of the extended strobe are at the same level). If subsequent slots of the extension of the strobe signal have increasing voltages then the extent to which the strobe may be extended may also be increased. For example lower and higher temperature ranges become accessible.
3. Reduced pixel pattern dependence for the data differences that may occur either during or immediately following the strobe extension are less significant in the switching compared to the increased strobe voltage level.
4. Additional method of temperature compensation, where not only is the degree of strobe extension increased on cooling, but also (or instead) the precise shape of the strobe i.e. the incremental steps may change with temperature.
5. The increased voltages used in the strobe are insignificant for the overall power consumption for devices with many lines (i.e. the disadvantage is small). The average strobe voltage need not be increased over driving techniques such as MALVERN 2 and MALVERN 3 since the strobe signal is ensuring that the voltage is used more efficiently.
6. Improved contrast and brightness, particularly when a kickback pulse is also applied.

The present invention also comprises any further invention disclosed herein, whether explicit or implicit, as would be understood by the skilled person.

What is claimed is:

1. A method of addressing a liquid crystal device comprising addressing a pixel of the device by applying a first signal to a selected one of a first plurality of electrodes of the device and applying a second signal to a selected one of a second plurality of electrodes of the device, such that the switching state of said pixel is determined by a resultant of said first and second signals applied to the selected electrodes which cross one another at the location of the pixel, and selecting said second signal from amongst at least a first data signal and a second data signal, said pixel being switched by said resultant from a first switching state to a second switching state when said second signal comprises said first data signal, and said pixel not being switched by said resultant but being maintained in said first switching state when said second signal comprises said second data signal, each of said first and second data signals having an overall duration and, within said overall duration, a discriminating period within which said data signal has a non-zero voltage in at least initial and final parts of said discriminating period and within which said resultant discriminates between (i) switching of said pixel to said second switching state and (ii) maintenance of said pixel in said first switching state, wherein said first data signal differs from said second data signal within at least a part of said discriminating period, wherein said first signal comprises a first portion applied during said discriminating period and a second portion applied after said discriminating period, and wherein at least a part of said second portion has a larger voltage magnitude than said first portion.

2. A method as claimed in claim 1, wherein said part of larger voltage magnitude has the same polarity as the first portion of the first signal.

3. A method as claimed in claim 1, wherein the second portion of the first signal comprises at least one further section having a still larger voltage magnitude.

4. A method as claimed in claim 1, wherein the second portion of the first signal further includes a further part of a lower voltage.

5. A method as claimed in claim 1, wherein the second portion of the first signal is at least partially coincident with the second signal which addresses a different pixel of the device.

6. A method as claimed in claim 1, wherein the voltage level of the second portion of the first signal is substantially continually varying.

7. A method as claimed in claim 1, wherein the second portion of the first signal has a duration of less than the first portion of the first signal.

8. A method as claimed in claim 1, wherein the second portion of the first signal has a duration greater than the duration of the first portion of the first signal.

9. A method as claimed in claim 1, wherein a resultant signal applied to the pixel comprises the first portion of the first signal combined with a first data signal followed by the second portion of the first signal combined with either a first data signal or a second data signal and provides a substantially optimum torque switching signal for the liquid crystal device over the duration of the first signal.

10. A method as claimed in claim 1, further comprising sensing temperature variations and altering a voltage of part of the second portion of the first signal in response to temperature variations.

11. A method as claimed in claim 1, further comprising sensing temperature variations and altering a duration of the second portion of the first signal in response to temperature variations.

12. A method as claimed in claim 1, wherein the duration of the first portion of the first signal is less than a minimum latching time for the liquid crystal.

13. A method as claimed in claim 1, further comprising applying a blanking signal to the first electrode of the device before applying the first signal.

14. A method as claimed in claim 1, wherein the larger voltage magnitude of the second portion of the first signal is no greater than double the magnitude of the voltage of the first portion of the first signal.

15. A method as claimed in claim 14, wherein the larger voltage magnitude of the second portion of the first signal is no greater than 1.5 times the magnitude of the voltage of the first portion of the first signal.

16. An apparatus for addressing a liquid crystal device comprising means for addressing a pixel of the device comprising first addressing means for applying a first signal to a selected one of a first plurality of electrodes of the device and second addressing means for applying a second signal to a selected one of a second plurality of electrodes of the device, such that the switching state of said pixel is determined by a resultant of said first and second signals applied to the selected electrodes which cross one another at the location of the pixel, said second signal being selected from amongst at least a first data signal and a second data signal, whereby said pixel is switched by said resultant from a first switching state to a second switching state when said second signal comprises said first data signal and said pixel is not switched by said resultant but is maintained in said first switching state when said second signal comprises said second data signal, each of said first and second data signals having an overall duration and, within said overall duration, a discriminating period within which said resultant discriminates between (i) switching of said pixel to said second switching state and (ii) maintenance of said pixel in said first switching state, wherein said first data signal differs from said second data signal within at least a part of said discriminating period, wherein the first addressing means is arranged to provide a first signal comprising a first portion applied during the discriminating period of the second signal and a second portion applied after the discriminating period of the second signal, at least part of said second portion of the first signal having a larger voltage magnitude than said first portion.

17. An apparatus as claimed in claim 16, wherein the first addressing means is arranged to provide said part of larger voltage magnitude having the same polarity as the first portion of the first signal.

18. An apparatus as claimed in claim 16, wherein the second portion of the first signal comprises at least one further section having a still larger voltage magnitude.

19. An apparatus as claimed in claim 16, wherein the second portion of the first signal further includes a further part of a lower voltage.

20. An apparatus as claimed in claim 16, wherein the second portion of the first signal is at least partially coincident with the second signal which addresses a different pixel of the device.

21. An apparatus as claimed in claim 16, wherein the voltage level of the second portion of the first signal is substantially continually varying.

22. An apparatus as claimed in claim 16, wherein the second portion of the first signal has a duration of less than the first portion of the first signal.

23. An apparatus as claimed in claim 16, wherein the second portion of the first signal has a duration greater than the duration of the first portion of the first signal.

24. An apparatus as claimed in claim 16, wherein a resultant signal applied to the pixel comprises the first portion of the first signal combined with a first data signal followed by the second portion of the first signal combined with either a first data signal or a second data signal and provides a substantially optimum torque switching signal for the liquid crystal device over the duration of the first signal.

25. An apparatus as claimed in claim 16, further comprising means for sensing temperature variations and means for altering a voltage of part of the second portion of the first signal in response to temperature variations.

26. An apparatus as claimed in claim 16, further comprising means for sensing temperature variations and means for altering a duration of the second portion of the first signal in response to temperature variations.

27. An apparatus as claimed in claim 16, wherein the duration of the first portion of the first signal is less than a minimum latching time for the liquid crystal.

28. An apparatus as claimed in claim 16, further comprising means for applying a blanking signal to the first electrode of the device before applying the first signal.

29. An apparatus as claimed in claim 16, wherein the means for applying the first signal is arranged to provide the larger voltage magnitude of the second portion of the first signal not exceeding double the magnitude of the voltage of the first portion of the first signal.

30. An apparatus as claimed in claim 29, wherein the means for applying the first signal is arranged to provide the larger voltage magnitude of the second portion of the first signal not exceeding 1.5 times the magnitude of the voltage of the first portion of the first signal.

31. A liquid crystal device comprising an array of electrodes arranged on substrates for containing a liquid crystal, means for addressing a pixel of the device comprising first addressing means for applying a first signal to a selected one of a first plurality of electrodes of the device and second addressing means for applying a second signal to a selected one of a second plurality of electrodes of the device, such that the switching state of said pixel is determined by a resultant of said first and second signals applied to the selected electrodes which cross one another at the location of the pixel, said second signal being selected from amongst at least a first data signal and a second data signal, whereby said pixel is switched by said resultant from a first switching state to a second switching state when said second signal comprises said first data signal and said pixel is not switched by said resultant but is maintained in said first switching state when said second signal comprises said second data signal, each of said first and second data signals having an overall duration and, within said overall duration, a discriminating period within which said resultant discriminates between (i) switching of said pixel to said second switching state and (ii) maintenance of said pixel in said first switching state, wherein said first data signal differs from said second data signal within at least a part of said discriminating period, wherein the first addressing means is arranged to provide a first signal comprising a first portion applied during the discriminating period of the second signal and a second portion applied after the discriminating period of the second signal, at least part of said second portion of the first signal having a larger voltage magnitude than said first portion.

32. A device as claimed in claim 31, wherein the first addressing means is arranged to provide said part of larger voltage magnitude having the same polarity as the first portion of the first signal.

33. A device as claimed in claim 31, wherein the second portion of the first signal comprises at least one further section having a still larger voltage magnitude.

34. A device as claimed in claim 31, wherein the second portion of the first signal further includes a further part of a lower voltage.

35. A device as claimed in claim 31, wherein the second portion of the first signal is at least partially coincident with the second signal which addresses a different pixel of the device.

36. A device as claimed in claim 31, wherein the voltage level of the second portion of the first signal is substantially continually varying.

37. A device as claimed in claim 31, wherein the second portion of the first signal has a duration of less than the first portion of the first signal.

38. A device as claimed in claim 31, wherein the second portion of the first signal has a duration greater than the duration of the first portion of the first signal.

39. A device as claimed in claim 31, wherein a resultant signal applied to the pixel comprises the first portion of the first signal combined with a first data signal followed by the second portion of the first signal combined with either a first data signal or a second data signal and provides a substantially optimum torque switching signal for the liquid crystal device over the duration of the first signal.

40. A device as claimed in claim 31, further comprising means for sensing temperature variations and means for altering a voltage of part of the second portion of the first signal in response to temperature variations.

41. A device as claimed in claim 31, further comprising means for sensing temperature variations and means for altering a duration of the second portion of the first signal in response to temperature variations.

42. A device as claimed in claim 31, wherein the duration of the first portion of the first signal is less than a minimum latching time for the liquid crystal.

43. A device as claimed in claim 31, further comprising means for applying a blanking signal to the first electrode of the device before applying the first signal.

44. A device as claimed in claim 31, wherein the means for applying the first signal is arranged to provide the larger voltage magnitude of the second portion of the first signal not exceeding double the magnitude of the voltage of the first portion of the first signal.

45. An arrangement as claimed in claim 44, wherein the means for applying the first signal is arranged to provide the larger voltage magnitude of the second portion of the first signal not exceeding 1.5 times the magnitude of the voltage of the first portion of the first signal.

46. A method of addressing a liquid crystal device comprising addressing a pixel of the device by applying a first signal to a selected one of a first plurality of electrodes of the device and a second signal to a selected one of a second plurality of electrodes of the device, such that the switching state of said pixel is determined by a resultant of said first and second signals applied to the selected electrodes which cross one another at the location of the pixel, and selecting said second signal from amongst at least a first data signal and a second data signal, said pixel being switched by said resultant from a first switching state to a second switching state when said second signal comprises said first data signal, and said pixel not being switched by said resultant but being maintained in said first switching state when said second signal comprises said second data signal, each of said first and second data signals having an overall duration, wherein said first data signal differs from said second data signal within at least a part of said overall duration, wherein said first signal comprises a first portion applied during said overall duration and a second portion applied after said overall duration, and wherein at least a part of said second portion has a larger voltage magnitude than said first portion.

47. A method of addressing a liquid crystal device comprising addressing a pixel of the device by applying a first signal to a selected one of a first plurality of electrodes of the device and a second signal to a selected one of a second plurality of electrodes of the device, such that the switching state of said pixel is determined by a resultant of said first and second signals applied to the selected electrodes which cross one another at the location of the pixel, and selecting said second signal from amongst at least a first data signal and a second data signal, said pixel being switched by said resultant from a first switching state to a second switching state when said second signal comprises said first data signal, and said pixel not being switched by said resultant but being maintained in said first switching state when said second signal comprises said second data signal, each of said first and second data signals having an overall duration, and, within said overall duration, (i) a discriminating period within which said first and second data signals have a non-zero voltage in at least initial and final parts of said discriminating period and (ii) a non-discriminating period within which the voltage of said first and second data signals is zero or a predetermined value of the same magnitude and polarity for both said first and second data signals, wherein said first data signal differs from said second data signal within at least a part of said discriminating period, wherein said first signal comprises a first portion applied during said discriminating period and a second portion applied after said discriminating period, and wherein at least a part of said second portion has a larger voltage magnitude than said first portion.

* * * * *